US005797809A

United States Patent [19]

Hyuga

[11] Patent Number: 5,797,809

[45] Date of Patent: Aug. 25, 1998

[54] GOLF COURSE GUIDANCE METHOD, GUIDANCE DEVICE, AND MANAGEMENT SYSTEM

[76] Inventor: Makoto Hyuga, 25-58, Misumi-cho 2-chome, Higashimurayama-shi Tokyo, 189, Japan

[21] Appl. No.: 454,286

[22] PCT Filed: Feb. 24, 1994

[86] PCT No.: PCT/JP94/00288

§ 371 Date: Jun. 16, 1995

§ 102(e) Date: Jun. 16, 1995

[87] PCT Pub. No.: WO95/23012

PCT Pub. Date: Aug. 31, 1995

[51] Int. Cl.[6] ..... A63B 71/06; G06F 15/44; G09F 17/00

[52] U.S. Cl. ..... 473/407; 473/131; 342/126; 342/357; 342/450; 340/500; 340/825.32; 340/323 R

[58] Field of Search ..... 473/407, 409, 473/156; 364/410, 444, 449, 458, 460, 556–557; 434/1, 252, 307 R; 342/357, 450, 451, 457, 458, 118, 126; 340/323 R, 500, 501, 825, 32

[56] References Cited

U.S. PATENT DOCUMENTS

| | | | |
|---|---|---|---|
| 4,086,630 | 4/1978 | Speiser et al. | 364/410 |
| 4,136,394 | 1/1979 | Jones et al. | 364/410 |
| 4,359,222 | 11/1982 | Smith, III et al. | 273/85 |
| 4,395,760 | 7/1983 | Soski et al. | 364/410 |
| 4,588,383 | 5/1986 | Parker et al. | 434/265 |
| 4,641,258 | 2/1987 | Kawanabe | 364/710 |
| 4,815,020 | 3/1989 | Cormier | 364/709.11 |
| 4,910,677 | 3/1990 | Remedio et al. | 364/410 |
| 4,926,161 | 5/1990 | Cipp | 340/572 |
| 5,056,106 | 10/1991 | Wang et al. | 473/407 |
| 5,086,390 | 2/1992 | Matthews | 364/410 |
| 5,095,430 | 3/1992 | Bonito et al. | 364/410 |

FOREIGN PATENT DOCUMENTS

| | | |
|---|---|---|
| 55-30530 | 7/1980 | Japan . |
| 61-10775 | 1/1986 | Japan . |
| 61-41476 | 2/1986 | Japan . |
| 62-94885 | 5/1987 | Japan . |
| 0123505 | 7/1989 | Japan . |
| 0392022 | 4/1991 | Japan . |
| 0408375 | 1/1992 | Japan . |
| 0420375 | 2/1992 | Japan . |
| 4341284 | 11/1992 | Japan . |

(List continued on next page.)

*Primary Examiner*—Jessica Harrison
*Assistant Examiner*—Mark A. Sager
*Attorney, Agent, or Firm*—Morrison Law Firm

[57] ABSTRACT

The invention relates to a golf course guidance device and the like to be used for giving guidance information about the holes and greens on a golf course. The holes and the greens on a golf course are respectively divided into small cells. For each hole, the location of a golf course guidance device is detected by a sub unit location detection means. By comparing the data from the cell corresponding to the location of the golf course guidance device the data from with each cell, which is read from a hole cell data table of a hole cell data storage means, the location and other data is displayed on a liquid crystal display, together with the distance and the direction to the center of the green. Further, the aforementioned distance is adjusted with the direction and speed of wind being taken into consideration. On each hole, the location of the golf course guidance device is detected by the sub unit location detection means by comparing the location of golf course guidance device with each cell in the same manner as above, and data for the corresponding cell, which is read from a green cell data table of a green cell data storage means, is displayed on liquid crystal display, together with the distance to the pin, the slope and grain of the green and so forth. A golf course management device detects the locations of a plurality of respective golf course guidance devices and displays them on a CRT display, thereby providing data for managing distances between players and conditions of game play.

23 Claims, 23 Drawing Sheets

U.S. PATENT DOCUMENTS

| | | | |
|---|---|---|---|
| 5,097,416 | 3/1992 | Matthews | 364/410 |
| 5,153,826 | 10/1992 | Johnson | 364/410 |
| 5,245,537 | 9/1993 | Barber | 364/410 |
| 5,267,147 | 11/1993 | Harshaw et al. | 364/401 |
| 5,283,733 | 2/1994 | Colley | 364/410 |
| 5,294,110 | 3/1994 | Jenkins et al. | 473/407 |
| 5,319,548 | 6/1994 | Germain | 473/407 |
| 5,324,028 | 6/1994 | Luna | 473/409 |
| 5,438,518 | 8/1995 | Bianco et al. | 473/407 |
| 5,469,175 | 11/1995 | Boman | 473/407 |

Fig. 8

HOLE CELL DATA TABLE

| Cell No. | Distance to Center of Green | Elevation Difference to Center of Green | Direction of Center of Green |
|---|---|---|---|
| : | : | : | : |
| 140 | 125 yd | 10 yd rise | In the direction of lone cedar |
| : | : | : | : |
| 320 | 260 yd | 15 yd rise | In the direction of steel tower |
| : | : | : | : |

Fig. 10

GREEN CELL DATA TABLE

| Cell No. | Distance to Cup | Slope Characteristic Leading to Cup | Grain | Line |
|---|---|---|---|---|
| : | : | : | : | : |
| 240 | 12 m | Fall | With Grain | 3 m slice |
| : | : | : | : | : |
| 50 | 8 m | Rise | Against Grain | 1 m hook |
| : | : | : | : | : |

Fig. 11

1. Competition setting
2. Member setting
3. Handicap setting
4. Club shot distance
5. Start
6. Hole Terrain
7. Measure distance
8. Terrain of green
9. Input score
10. Guidance for next hole
11. Driving contest Measurement
12. Near-pin contest measurement
13. Total
14. Meal order
15. Automatic operation
16. Rule Book
17. Meter/yard conversion
18. Golf course guide
19. Setting account
20. Emergency

Fig. 12

| OUT | | Nakadori | Akagi | Kadoyama | Morikawa |
|---|---|---|---|---|---|
| 1 | 4 | $4_1$ | $5_2$ | $3_0$ | $4_2$ |
| 2 | 3 | $3_2$ | $4_2$ | $2_1$ | $5_3$ |
| 3 | 5 | $7_3$ | $5_2$ | $6_2$ | $7_2$ |
| 4 | 4 | | | | |
| 5 | 4 | | | | |
| 6 | 4 | | | | |
| 7 | 4 | | | | |
| 8 | 5 | | | | |
| 9 | 3 | | | | |
| Total | 36 | | | | |

| IN | | Nakadori | Akagi | Kadoyama | Morikawa |
|---|---|---|---|---|---|
| 10 | 4 | | | | |
| 11 | 5 | | | | |
| 12 | 4 | | | | |
| 13 | 3 | | | | |
| 14 | 4 | | | | |
| 15 | 5 | | | | |
| 16 | 3 | | | | |
| 17 | 4 | | | | |
| 18 | 4 | | | | |
| Total | 36 | | | | |
| Gross | | | | | |
| NET | | | | | |

| | | | |
|---|---|---|---|
| 9 H | BT | KG 245 yd | BG 252 yd |
| | RT | KG 191 yd | BG 202 yd |
| | LT | KG 101 yd | BG 98 yd |

Recommended club : 3-iron

GOLF COURSE GUIDANCE METHOD, GUIDANCE DEVICE, AND MANAGEMENT SYSTEM

BACKGROUND OF THE INVENTION

This invention relates to a golf course guidance method to be used for giving guidance on a golf course, a device for same, and a system to manage a golf course.

On golf courses, information regarding conditions of the course is usually given to players by caddies and/or signposts.

For example, after a tee shot, the remaining distance to the green for the second shot, the third shot or shots thereafter is usually given depending on the caddie's instincts, or is calculated according to markers such as trees and stakes arranged along the fairway.

However, it requires considerable expertise to estimate the remaining distance through instinct, because of changes in the appearance of the environs due to the season, the weather, the surroundings and so forth. Furthermore, the number of self-service golf courses, which have no caddies, has been increasing over recent years. On such golf courses, to estimating the remaining distance is even more difficult.

When there are no caddies on a blind hole. Where the course dog legs so that it is not possible to look ahead, a player himself has to make sure that there are no other players playing in front of him before shooting a ball. Otherwise, it is very dangerous because he might hit the ball into the preceding party. On the other hand, checking for himself that there are no other players in front of him before each shot delays the play, causes unnecessary trouble for the player, reducing the pleasure of the game.

Furthermore, information on signposts alone is not sufficient to inform of natural conditions of the terrain including the rise and fall of each hole, woods and various hazards such as ravines, streams and ponds, as well as bunkers, out of bounds, one-penalty areas and other man-made terrain conditions related to rules to a satisfactory extent; with signpost information alone, it is especially difficult to know the slope or grain of a green.

When counting total scores in a competition, score management is troublesome and takes a long time, and it is impossible to determine the ranking of all players until the last player has holed out and reached the caddie house so that the score cards of all the players can be collected for tabulation. Especially in the case of scoring according to the Peoria system, or the New Peoria system, which call for deciding each player's handicap using secret holes, it is not easy for a player to know even his own net score.

As described above, conventional methods make it necessary to use one's instincts or the like to know various conditions of each hole, including the green, and are therefore inaccurate, tedious or may present danger.

Furthermore, they present another problem in that it is not easy to calculate total scores or ascertain the players' situations.

OBJECTS AND SUMMARY OF THE INVENTION

In order to solve the problems in the prior art, an object of the invention is to provide a golf course guidance method to be used for giving guidance to players on a golf course, a device for same, and a system to manage a golf course, said method being capable of facilitating knowing of conditions of holes and players as well as totaling of scores.

A golf course guidance method according to the invention includes dividing the plan view of each hole into small cells, storing data for the area corresponding to: each cell beforehand, choosing two cells out of the aforementioned cells and reading out stored data regarding the area between the two chosen cells to. As data for each cell is stored, it is possible to give guidance as to the area between any two locations in the form of approximate data by using the corresponding cells. Thus, the invention is capable of providing information with a minimal quantity of stored data regarding the area between any two locations within the boundary of a hole.

A golf course guidance method according to another feature of the invention calls for dividing the plan view of each hole into small cells, storing data for each cell beforehand, detecting the location of the user himself with reference to said cells and reading out the stored data regarding the cell which corresponds to the detected location. As the method calls for storing data for each cell and detecting the location of the user himself, it is possible to give guidance information as to the approximate location of the user by using the corresponding cell. Thus, the invention is capable of providing information with a minimal quantity of stored data regarding the location of the user.

A golf course guidance method according to yet another feature of the invention calls for dividing plan view of each hole into small cells, storing locational data for each cell beforehand, choosing two out of those cells, and calculating the distance between the two chosen cells based on the locational data for both cells to provide guidance as to this distance. As the method calls for storing data for each cell and is capable of giving guidance as to the approximate distance between two chosen locations by using the corresponding cells, the invention is capable of providing information with a minimal quantity of stored data regarding the distance between any two locations.

A golf course guidance device according to a feature of the invention is provided with a cell data storage means to divide the plan view of each hole into small cells and store data for each cell, a sub unit location detection means for detecting its own location with reference to said cells, and a guidance display means to display the data which is stored in said cell data storage means and corresponds to the location detected by the sub unit location detection means. With the configuration as above, by means of storing data for each cell in the cell data storage means and detecting its own location by using the sub unit location detection means, it is possible to give guidance as to its own approximate location by using the corresponding cell. Thus, the device is capable of providing information with a minimal quantity of stored data regarding its own location.

A golf course guidance device according to another feature of the invention is provided with a cell data storage means to divide the plan view of each hole into small cells and store data for each cell, a sub unit location detection means for detecting its own location with reference to said cells, a computing means to calculate the distance to a specified location based on the data which is stored in the cell data storage means and corresponds to the location detected by the sub unit location detection means, and a guidance display means to display the distance calculated by the computing means. With the configuration as above, by storing data for each cell in the cell data storage means, detecting its own location by using the sub unit location detection means, and calculating the distance to the cell corresponding to the specified location using the computing means, it is possible to give guidance as to its own approximate location by using the corresponding cell. Thus, the device is capable of providing information with a minimal quantity of stored data regarding its own location.

A golf course guidance device according to yet another feature of the invention is provided with a cell data storage means to divide the plan view of each hole into small cells and store data for each cell, a cell input means to choose and input the cell whose data is required, and a guidance display means to display the data which corresponds to the cell input by the cell input means and is stored in the cell data storage means. With the configuration as above, data for each cell is stored in the cell data storage means, the cell whose data is required is chosen and input by the cell input means, and guidance regarding the desired cell is given by the display means. Thus, the device is capable of providing information with a minimal quantity of stored data regarding its own location.

A golf course guidance device according to yet another feature of the invention is provided with a hole cell data storage means that divides the plan view of respective holes into small cells and stores data for each cell, and a green cell data storage means to divide the bird's-eye view of respective greens of said holes into small cells and store data for each cell. With the configuration as above, as data about the hole are stored in the hole cell data storage means while data about the greens are stored in the green cell data storage means, it is possible to, for example, vary the size of each cell and store different types of data depending on the cell. Thus, the device is capable of providing detailed information with flexibility.

A golf course guidance device according to yet another feature of the invention is provided with a hole terrain data storage means to store data regarding the terrain of each hole, a green data storage means to store data for conditions of the green of each hole, a distance measuring means to measure the distance to the pin on a green, and a guidance display means to display data stored in the hole terrain data storage means and/or the green data storage means and also to display a distance measured by the distance measuring means. With the configuration as above, as a device according to the invention stores data for the terrain of each hole in the hole terrain data storage means, stores data for the green of each hole in the green data storage means, measures the distance to the pin on a given green by means of the range finding means, and displays data by means of the guidance display means, it is easy to know the conditions of each hole and green as well as the distance to the pin of each hole.

A golf course guidance device according to yet another feature of the invention is provided with a hole terrain data storage means which has an elevation storage means to store data regarding differences in elevation at various locations from the tee ground to the green of a hole and a plan view storage means to store data of the plan view of the terrain from said tee ground to the green of each hole. With the configuration as above, as the hole terrain data storage means stores data for differences in elevation of the area from the tee ground to the vicinity of the green by means of the elevation storage means and also stores data for the plan view of the area from the tee ground to the vicinity of the green by means of the plan view storage means, it is easy to determine the actual necessary distance.

A golf course guidance device according to yet another feature of the invention is provided with a green data storage means which includes a grain storage means to store data regarding conditions of the grain of the grass and a slope storage means to store data regarding slope conditions of respective greens. With the configuration as above, as the green data storage means stores data for conditions of the grain of each green by means of the grain storage means and also data for slopes of greens by means of the slope storage means, it is easy to know how much and in which direction the ball would roll.

A golf course guidance device according to yet another feature of the invention is provided with a score storage means to store the gross score for each hole and a score input means to input gross scores in the score storage means. With the configuration as above, as a device according to the invention inputs gross scores by using the score input means and stores gross scores for each hole in the score storage means, it is capable of easily summing up scores and store the result of the calculation.

A golf course guidance device according to yet another feature of the invention is provided with a handicap setting means to determine a handicap of each player and a net score computing means to calculate a net score of a player based on his handicap set in the handicap setting means and his gross score stored in the score storage means. With the configuration as above, as a device according to the invention determines handicaps by using the handicap setting means and calculates net scores from respective gross scores based on handicaps set by the handicap setting means, it is capable of easily computing total scores.

The handicap setting means of a golf course guidance device according to yet another feature of the invention is provided with a secret hole setting means to determine a specified number of secret holes and a handicap computing means to compute the handicap of each player based on his gross scores stored in the score storage means for the respective secret holes determined by the secret hole setting means. With the configuration as above, as the handicap setting means of a device according to the invention determines a specified number of secret holes by using the secret hole setting means and computes, by using the handicap computing means, a handicap of each player based on his gross scores stored in the score storage means for the respective secret holes determined by the secret hole setting means, it is capable of easy and rapid computing of scores.

A golf course guidance device according to yet another feature of the invention is provided with a warning means to give an alarm when the distance between the device and another golf course guidance device comes within a range defined by specified conditions. With the configuration as above, as a device according to the invention gives an alarm through the warning means in cases where, for example, the distance to the party immediately in front of the user comes within a specified distance, it is capable of preventing such an accident as hitting into another party.

Further, a golf course management system according to the invention is provided with a golf course guidance device and a golf course management device, wherein the golf course guidance device has a sub unit communication means, and the golf course management device has a main unit communication means to communicate with the sub unit communication means. With the configuration as above, as communication between the sub unit communication means of a golf course guidance device and the main unit communication means of the golf course management device is possible, it is possible to know the status of players by means of the golf course management device and also to easily receive support of the caddie master and so forth through the golf course guidance device. Thus, the system according to the invention is capable of performing management tasks easily.

The golf course management device of a golf course management system according to another feature of the invention is provided with a main unit location detection means to detect the location of a golf course guidance device and a display means used for management to display the location of the golf course guidance device which has been detected by the main unit location detection means. With the configuration as above, as the golf course management device detects the location of a golf course guidance device by using the main unit location detection means and displays the location of the golf course guidance device using the display means used for management, it is easy to manage conditions of players.

Furthermore, a golf course management system according to yet another feature of the invention is provided with a golf course guidance device and a golf course management device, wherein the golf course guidance device has a sub unit communication means to transmit data stored in a score storage means, and the golf course management device has a main unit communication means to receive data from the sub unit communication means and also a tabulation means to total and tabulate the data received by the main unit communication means. With the configuration as above, data in a score storage means of a golf course guidance device is transmitted by the sub unit communication means, the data transmitted from the sub unit communication means is received by the main unit communication means of the golf course management device, and the received data is totaled by the tabulation means. Therefore, it is easy to gather and total the scores of all players.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 8 is an explanatory drawing of a hole cell data table of same;

FIG. 10 is an explanatory drawing of a green cell data table of same;

FIG. 11 is an explanatory drawing showing an image which displays a menu of a golf course guidance device of same;

FIG. 12 is an explanatory drawing showing an image which displays scores stored in a golf course guidance device of same;

DETAILED DESCRIPTION OF THE PREFERRED EMBODIMENT

Figure 1:
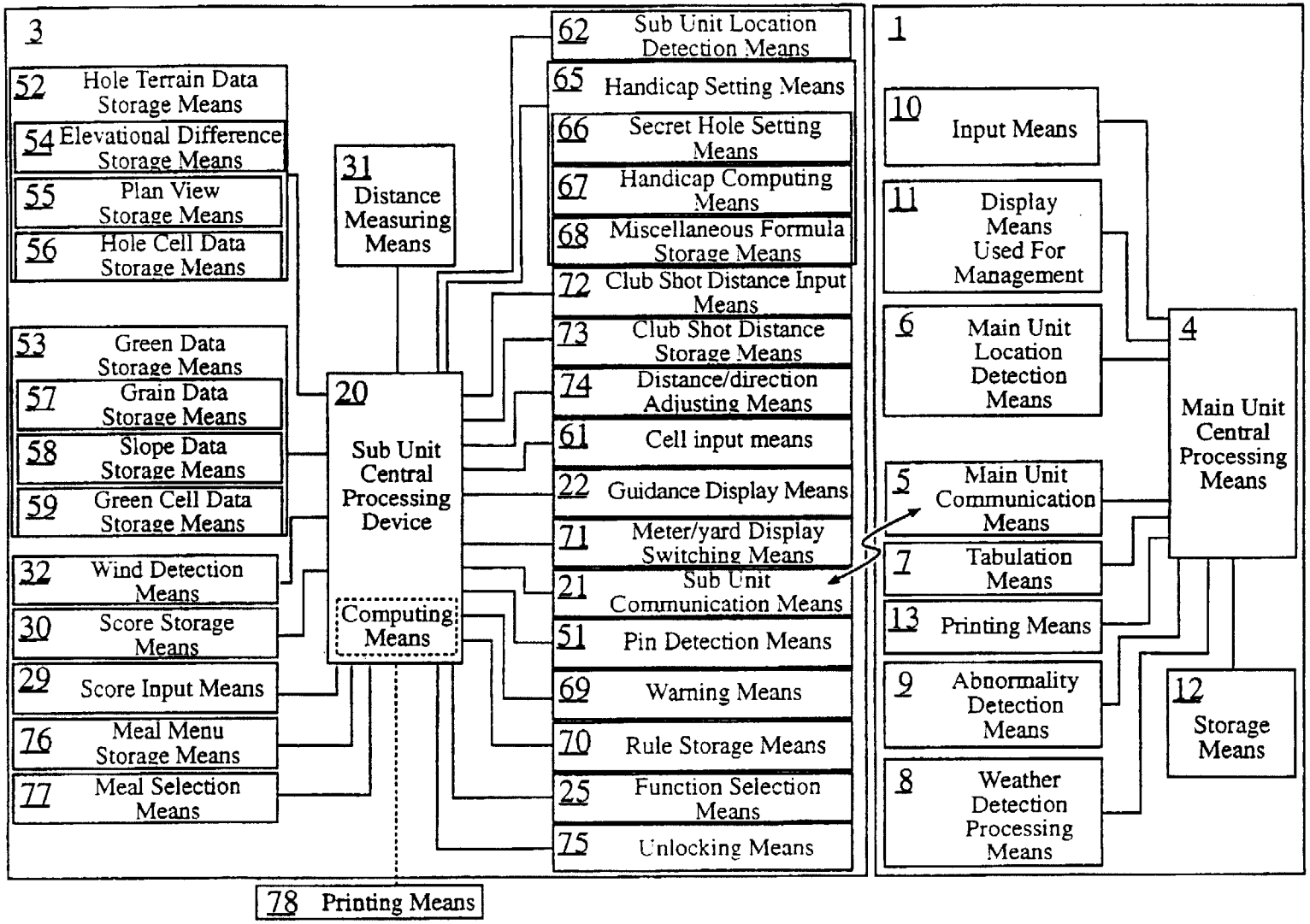
FIG. 1 is a block diagram illustrating a golf course management system according to an embodiment of the present invention.

Next, a golf course management system according to an embodiment of the present invention is explained hereunder, referring to the drawings.

Figure 2:
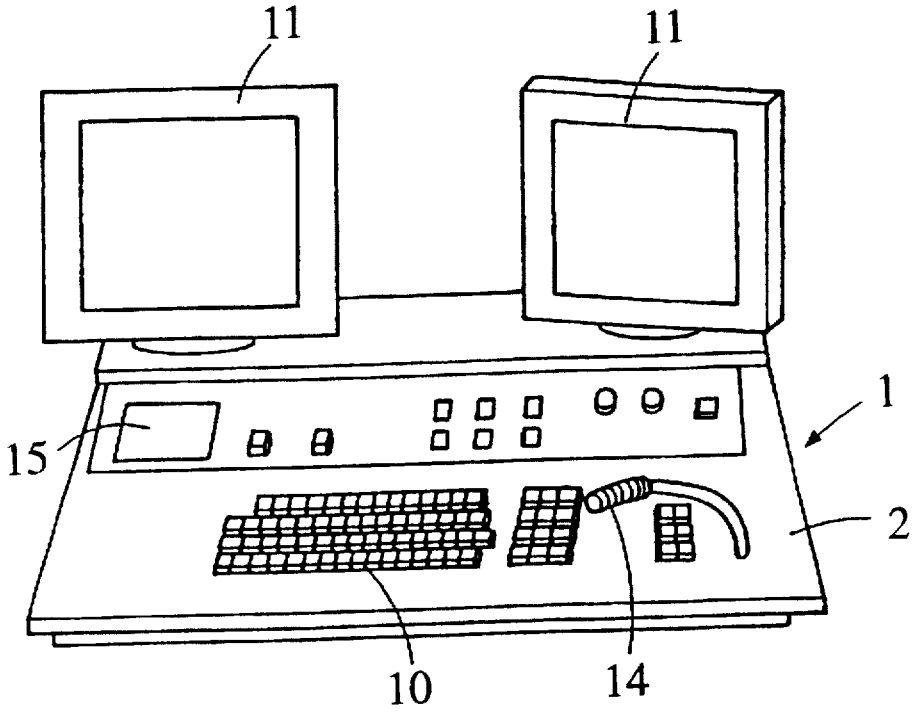
FIG. 2 is an oblique view of a golf course management device of same.

In FIG. 1, numeral 1 denotes a golf course management device which serves as the main unit. Golf course management device 1 comprises a console 2 as shown in FIG. 2 and is provided with a plurality of portable golf course guidance devices 3 as the one shown in FIG. 3 such, each golf course guidance device 3 corresponding to golf course management device 1 and serving as a sub unit thereto.

Golf course management device 1 is also provided with a main unit central processing device 4 constituted by a CPU or the like. Connected to this main unit central processing device 4 is a main unit communication means 5 to communicate with golf course guidance devices 3 by way of on-line communication, radio waves or the like.

Also provided is a main unit location detection means 6 to detect the location of a golf course guidance device 3 of each hole. Means by which main unit location detection means 6 detects the location of a golf course guidance device 3 may, for example, include the following systems or a combination thereof. The location detection means may use a plurality of radars (for example three radars) which are disposed beforehand in each hole or over the entire grounds of the golf course; or it may detect a location of golf course guidance device 3 based on signals which are sent by golf course guidance device 3 upon detecting its own location by means of GPS (Global Positioning System) using a satellite or, instead of GPS but in the same manner, by receiving signals from a plurality of transmitters (for example three transmitters) which are disposed beforehand in each green, each hole or over the entire grounds of the golf course.

Further provided is a tabulation means 7 which has a function as a net score computing mean. Tabulation means 7 computes net scores based on scores transmitted by a golf course guidance device 3. In cases where a standard handicap system is used, it computes net scores by subtracting the handicaps of respective players from their gross scores and determine their ranks in the order of net scores ranked in the order of lowest score at the top. On the other hand, according to the Peoria or the New Peoria system, it computes the handicap of each player based on predetermined secret holes and then computes his net score by subtracting the handicap from his gross score. In cases where a plurality of players have the same net score, such other factors as age difference, priority to a player with a lower handicap, priority to a player having a lower in score (or out score) and so on, so that which player should be ranked higher can be determined based on one or more arbitrary factors.

Main unit central processing device 4 is also provided with a weather detection means 8 which detects weather conditions, such as thunder, temperature, direction and speed of wind and so on, or inputs various weather information.

Also provided is an abnormality detection means 9 to detect, for example, any abnormal condition or occurrence on the course outside normal operating hours for the purpose of security.

Further, a keyboard 10 which serves as an input means is provided on the front part of the top of console 2 shown in FIG. 2 so that various conditions and values can be input to main unit central processing device 4 by means of keyboard 10.

Provided on the top of the rear part of console 2 are two CRT displays 11 serving as a display means used for management, which may respectively display data regarding "in" and "out" or various different and/or independent information.

Further, a memory 12 serving as a storage means to store various data is connected to console 2.

A printer 13 serving as a printing means is provided in order to print out competition scores and other scores and values computed by the system as well as accounting and other management data.

Golf course management device 1 is provided with a microphone 14 for sound input and a speaker 15 for sound output.

In the same manner as golf course management device 1, each golf course guidance device 3 is provided with a sub unit central processing device 20 which is comprised of a CPU or a similar device and has a function as a computing means.

Each golf course guidance device 3 has a sub unit communication means 21 in order to communicate with golf course management device 1 or another golf course guidance device.

Figure 3:
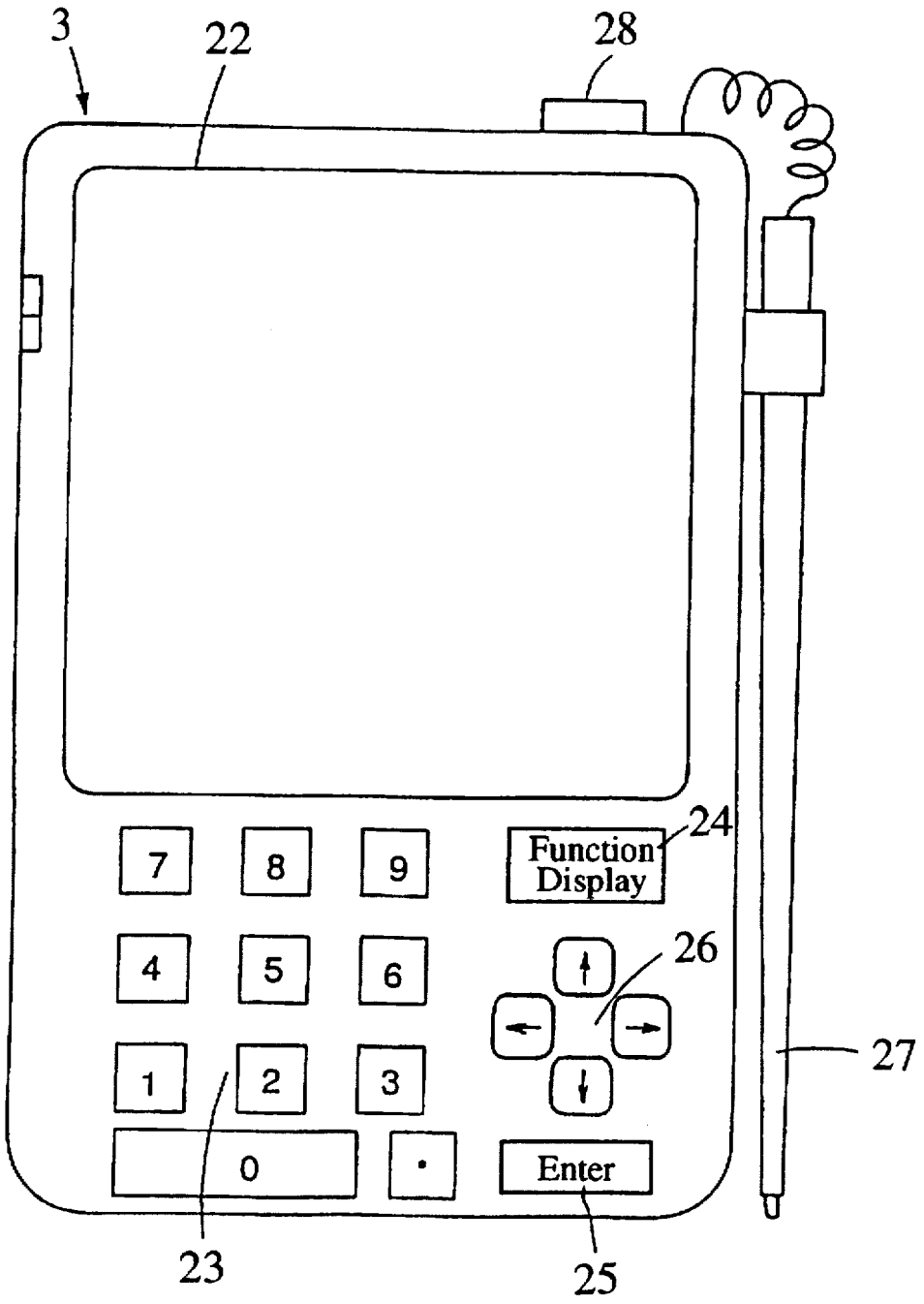
FIG. 3 is a front view of a golf course guidance device of same.

As shown in FIG. 3, in addition to a liquid crystal display 22 which occupies more than a half area of the entire face of golf course guidance device 3 and serves as a guidance display means, golf course guidance device 3 is provided with a ten-key pad 23, a function display key 24 to display functions, an enter key 25 as a function selection means, and scroll keys 26, as well as a light pen 27 attached to the device. Furthermore, an emergency button 28 is provided on the top of golf course guidance device 3. Sub unit central processing device 20 is connected to a score input means 29 comprising ten-key pad 23 and so on and is also connected to a score storage means 30 which stores scores input by score input means 29.

Also connected to sub unit central processing device 20 are a distance measuring means 31 and a wind detection means 32 in order to measure the distance to pin 41 on a green and detect the direction and speed of wind above the green.

Figure 5:
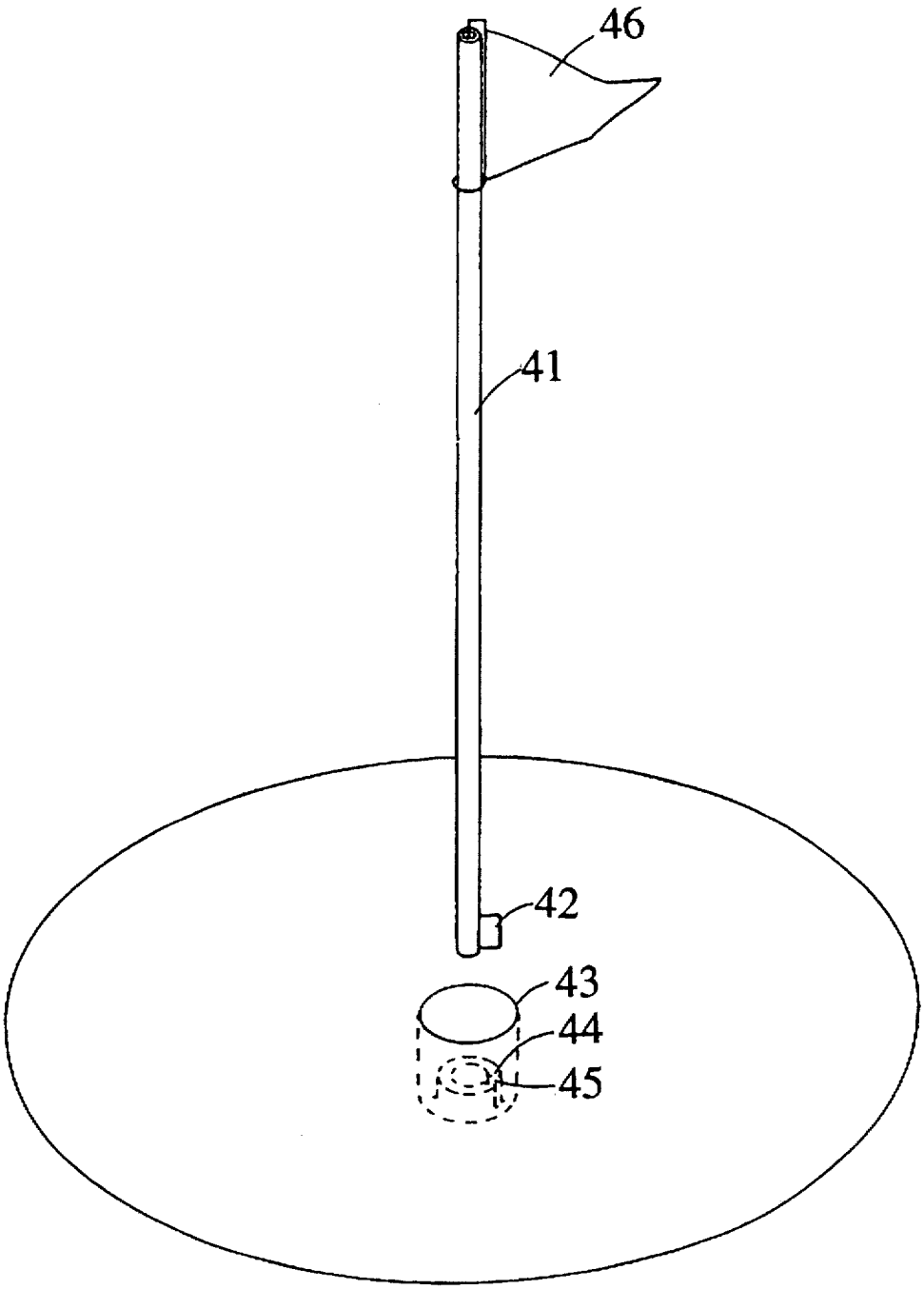
FIG. 5 is an oblique view showing the pin, the cup and its vicinity shown in FIG. 4.

An example of configuration of pin 41 is shown in FIG. 5, where a fitting projection 42 projects from the bottom of pin 41 in the radial direction and becomes fitted in a catching slot 45 of a pin stopper 44 provided in a cup 43 of a green so that pin 41 is securely positioned so as to be constantly oriented in one direction with respect to the horizontal direction when being inserted and fitted in cup 43.

Pin 41 is provided with a flag 46 in such a manner that when pin 41 is exposed to wind at its upper portion, flag 46 is free to pivot around the pin according to the direction of the wind and also flutter at an intensity corresponding to the speed of the wind.

Figure 6:
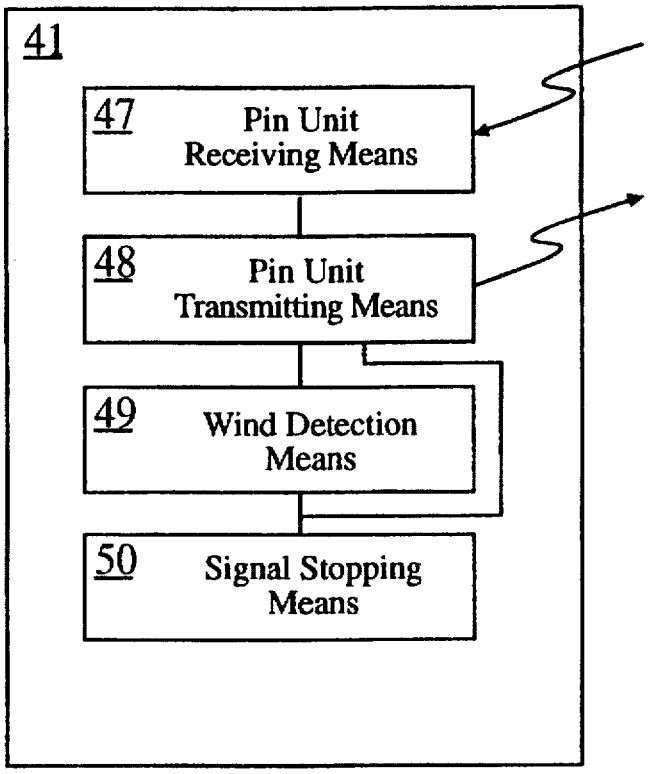
FIG. 6 is a block diagram illustrating a device disposed inside the pin.

As shown in FIG. 6, provided inside pin 41 are a pin unit receiving means 47 to receive signals from golf course guidance device 3, a pin unit transmitting means 48 to transmit signals to golf course guidance device 3, and a wind detection means 49 to detect the direction and speed of wind based on the orientation and intensity of fluttering of flag 46. Further, using the outer cover of pin 41 as an antenna makes it unnecessary to specially provide an antenna in the form of a projecting member and therefore prevents pin 41 from breakage or damage which may otherwise occur when pin 41 is set in or removed from a cup.

Distance measuring means 31 sends out signals in the form of, for example, radio waves at a specific frequency, which are received by pin unit receiving means 47 of pin 41. Pin unit transmitting means 48 sends out radio waves at a different frequency from that of the received waves. Golf course guidance device 3 receives the waves sent by pin unit transmitting means 48 and measures the length of time from sending out the signals to receiving the incoming signals, thereby calculating the distance from itself, i.e. golf course guidance device 3, to pin 41 on the green. Signals sent out by pin unit transmitting means 48 include information of the direction and speed of the wind above the green which have been detected by wind detection means 49 so that wind detection means 32 of golf course guidance device 3 detects the direction and speed of the wind. In cases where pin 41 is fitted in cup 43, pin unit transmitting means 48 sends out signals regarding the direction and speed of wind at intervals of, for example, every second. In cases where pin 41 is not set in cup 43, pin unit transmitting means 48 is prevented from sending signals by a signal stopping means 50 so that whether pin 41 is set in cup 43 can be confirmed.

In addition to the aforementioned devices handling radio waves, distance measuring means 31 may be provided with, for example, an infrared sensor for triangulation range finding and a PSD. In this case, golf course guidance device 3 is placed at a specified location on a green so that pin 41 is on the extension of the base length of the light emitting means, i.e. the infrared diode in this case, and the PSD. Then infrared light is emitted by the infrared diode, and the infrared light reflected by pin 41 is received by a suitable light receiving means, i.e. the PSD in this case, so that the distance between golf course guidance device 3 and pin 41 is measured based on the location where the PSD has received the infrared light.

Golf course guidance device 3 is also provided with a pin detection means 51 which permits golf course guidance device 3 to judge whether signals are transmitted from pin 41 at intervals of, for example, every second as described above and, when there is no signal, detect that pin 41 is not set in cup 43.

A hole terrain data storage means 52 and a green data storage means 53 are connected to sub unit central processing device 20.

Hole terrain data storage means 52 has an elevation difference storage means 54, a plan view storage means 55 and hole cell data storage means 56. Elevation difference storage means 54 stores data regarding elevation difference in vertical sectional views of the terrain from the tee ground to the green of each hole, data to be stored either continuously covering the entire terrain or corresponding to various individual locations. Plan view storage means 55 stores data of a plan view of the terrain from the tee ground to the vicinity of the green of each hole. More specifically, it stores natural conditions of the terrain including woods and various hazards such as ravines, streams and ponds, as well as bunkers, out of bounds areas, one-penalty areas and other man-made terrain conditions related to rules.

Figure 7:
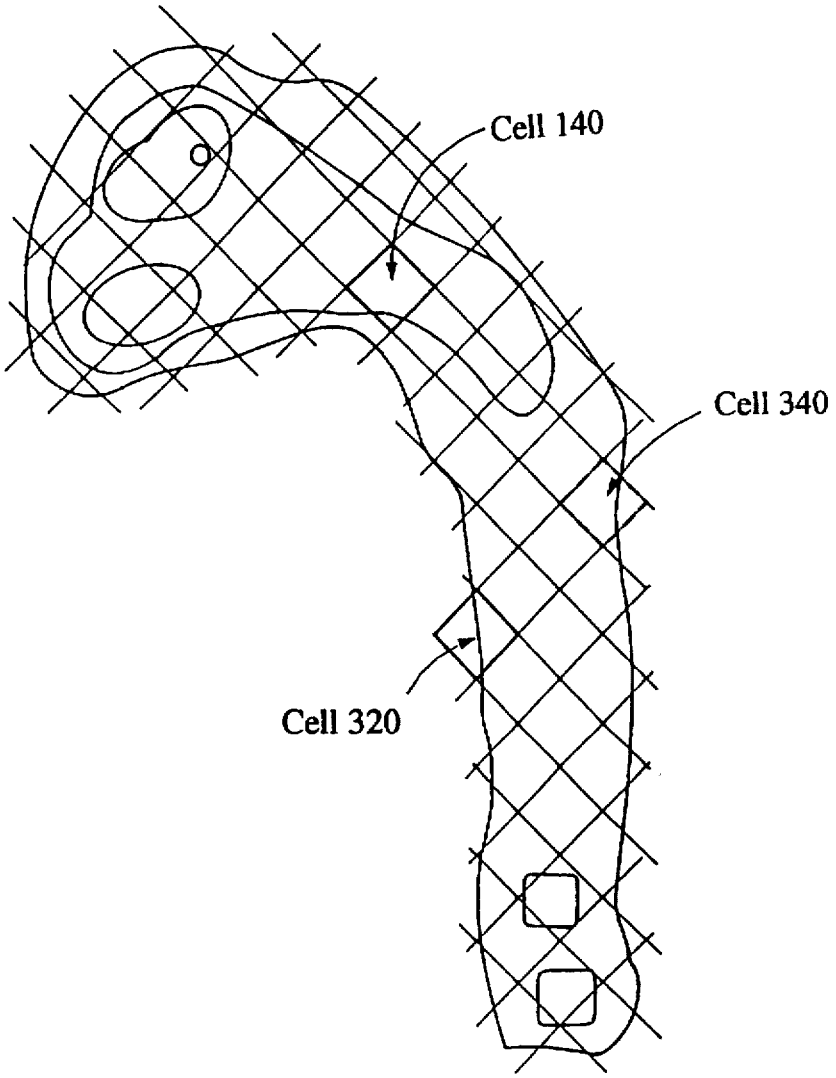
FIG. 7 is an explanatory drawing of a hole divided by hole cells of said embodiment.

The number of hole cell data storage means 56 corresponds to a total number of greens of all the holes. This means that if a hole has two greens, for example one with Korean grass and another with sent grass, two hole cell data storage means 56 are provided for that hole. As shown in FIG. 7, each hole cell data storage means 56 divides the terrain from the tee ground to the green of the hole corresponding thereto into small cells in a matrix which measures, for example, 3 m on a side and stores data for each cell as shown in FIG. 8 with regard to a straight-line distance to the center of the green, an elevation difference of the area between the cell and the center of the green, a marker to aim at the center of the green and the location in the corresponding hole represented by the cell.

Further, green data storage means 53 includes a grain data storage means 57, a slope data storage means 58 and a green cell data storage means 59 so that conditions of the green of each hole is stored, grain data storage means 57 and slope data storage means 58 respectively storing data concerning grain of grass and conditions of the slopes.

Figure 9:
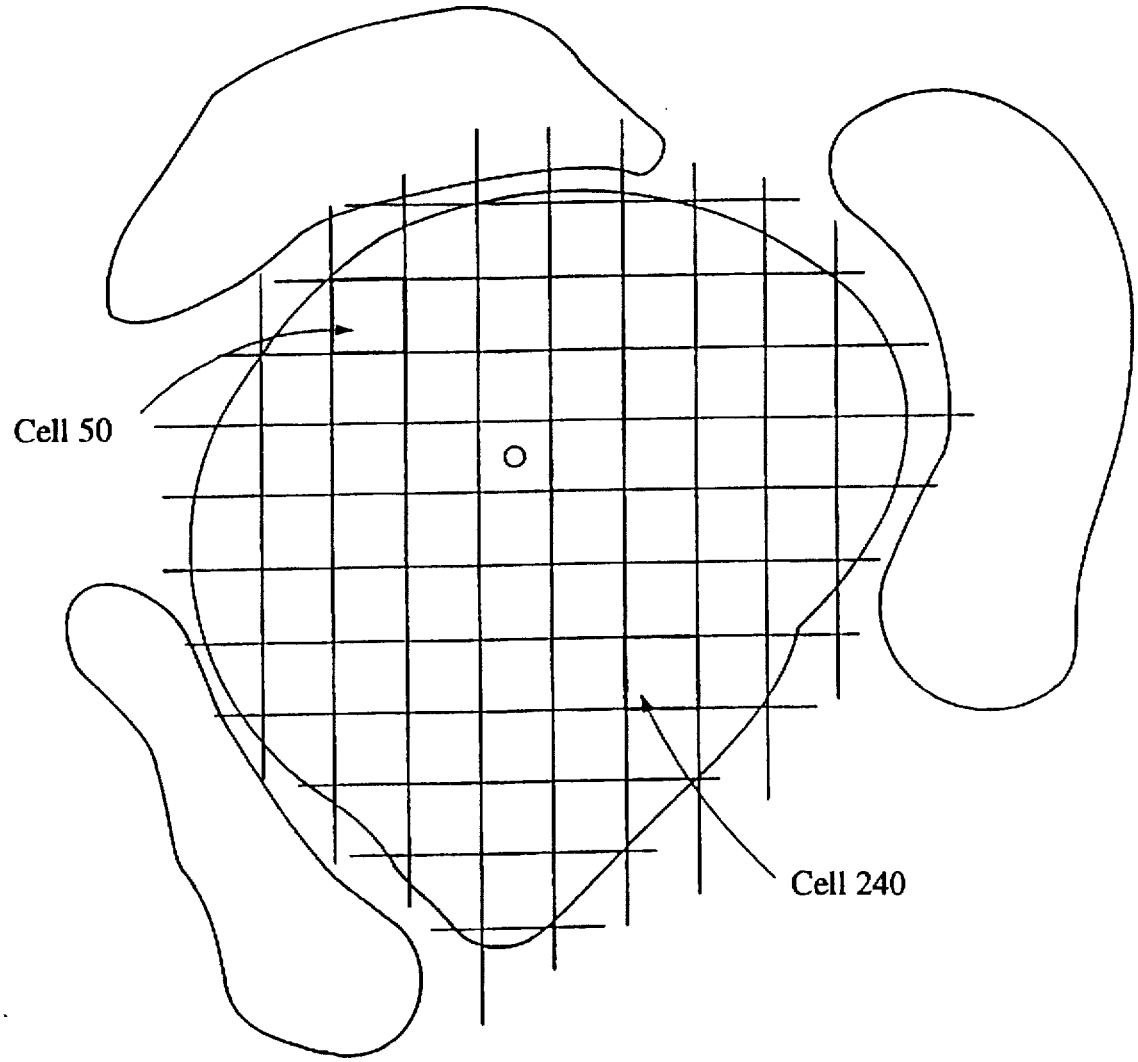
FIG. 9 is an explanatory drawing of a green divided by green cells of said embodiment.

In the same manner as above, a number of green cell data storage means 59 corresponds to a total number of greens of all the holes. This means that if a hole has two greens, for example one with Korean grass and another with bent grass, two green cell data storage means 59 are provided for that hole. As shown in FIG. 9, each green cell data storage means 59 divides the green corresponding thereto into small cells in a matrix which measures, for example, 30 cm on a side and stores data for each cell in the form of the relationship between two cells as shown in FIG. 10, i.e. a straight-line distance to the center of the green, an elevation difference of the area between the cell and the center of the green, and how to aim for the center of the green.

Also provided is a cell input means 61, which has a configuration such that a cell number is designated by means of a ten-key pad 23 or a light pen 27 so that data for the designated cell is displayed.

Golf course guidance device 3 is provided with a sub unit location detection means 62 which detects a current location of the golf course guidance device 3 itself. Sub unit location detection means 62 may perform location detection in any appropriate manner: for example, with reference to cells, or regardless of cells.

Sub unit central processing device 20 is provided with a handicap setting means 65, which may simply input the handicap of respective players in cases where a game is played using a standard handicap system. On the other hand, in cases where secret holes have to be set according to the Peoria or the New Peoria handicap system, secret holes are designated by a secret hole setting means 66, and the respective handicaps of players are computed by a handicap computing means 67. For determining secret holes, numerous patterns are set beforehand; for example, secret holes may be selected by a lottery which has each player choose any three-digit number, or they may be automatically selected by using a table of random numbers or based on data transmitted from golf course management device 1. In cases where a player to compete with other players uses a handicap different from the one set for him in the competition setting, any desired computation formula may be set and stored in a miscellaneous formula storage means 68.

Further, sub unit central processing device 20 is provided with a warning means such as a bell.

Also provided is a rule storage means 70 which writably stores data for rules and is capable of rewriting rules whenever they are revised.

There is also a meter/yard display switching means 71 to convert data displayed in the metric system to values in the yard system or vice versa.

When a player inputs his average shot distance for each club through a club shot distance input means 72, the input data is stored in a club shot distance storage means 73 and adjusted by a distance/direction adjusting means 74 according to elevation difference stored in hole terrain storage means 52 as well as the direction and speed of the wind detected by wind detection means 32. With the data thus being adjusted, a necessary distance is computed, and an appropriate club is selected to be recommended.

Further, an unlocking means 75 which is capable of unlocking lockers and/or safety boxes using radio waves or infrared rays is provided. Unlocking means 75 may be so configured as to store data for code numbers in order to improve security.

Furthermore, a meal menu storage means 76 to store a menu of dishes and a meal selection means 77 to permit selection from the meal menu are provided. Dishes selected by meal selection means 77 are transmitted by sub unit transmitting means 21.

An external printer 78 may be so connected to golf course guidance device 3 as to be free to be removed and reconnected.

Next, operation of the above embodiment is described hereunder.

First of all, operate function display key 24 of golf course guidance device 3 to display a menu shown in FIG. 11 on liquid crystal display 22. Then, using scroll keys 26, move to a desired category in the menu and select it by operating enter key 25.

For example, in case of a competition, select "1. Competition Setting" and then cause liquid crystal display 22 to display the image of "(1) Competition Setting; (2) Non-Competition Setting". Upon choosing the competition setting category, transmit the data from sub unit communication means 21 so that data for all players participating in the competition is received by main unit communication means 5 of golf course management device 1 and registered and stored in memory 12. Further, data required for this competition setting may be stored in memory 12 by operating keyboard 10 of golf course management device 1 instead.

When setting members, choose "2. Member Setting" so that a score frame is displayed on liquid crystal display 22 as shown in FIG. 12, and then register the names of participants in kanji or kana characters through code input or any other suitable means. This member setting, too, may be executed by operating keyboard 10 of golf course management device 1 and transmitting the data from main unit communication means 5 to sub unit communication means 21 of golf course guidance device 3 and that the names of the members are stored in its score storage means 30.

Further, when setting handicaps, choose "3. Handicap Setting" and then cause liquid crystal display 22 to display the image of "(1) Normal Handicap; (2) Peoria; (3) New Peoria; (4) Callaway; . . . " and so on. When choosing the normal handicap system, move to "(1) Normal Handicap" in the menu by using scroll keys 26 and select it by operating enter key 25. Then, input the handicaps of respective members by means of ten-key pad 23, thereby permitting them to be stored in handicap setting means 65. In cases where the Peoria or the New Peoria handicap system is applied, choose "(2) Peoria" or "(3) New Peoria" and then allow secret hole setting means 66 to specify secret holes automatically or using codes under predetermined conditions. In this case, too, handicaps may be set by operating keyboard 10 of golf course management device 1. Further, in case of a competition or other similar occasions, handicaps may be set by golf course management device 1 by means of, for example, choosing the same secret holes for all the players stored in memory 12 and transmit the data through main unit communication means 5 so that all the corresponding sub unit communication means 21 receive signals and that the data designating the same secret holes are stored in secret hole setting means 66 of handicap setting means 65 of each golf course guidance device 3.

When setting a club shot distance, choose "4. Club Shot Distance". Upon selection for this command for club shot distance, cause the item "1-wood (Driver)" to be displayed and then, if the player's shot distance is, for example, 250 yd, input the figure "250" by using ten-key pad 23 as club shot distance input means 72 and operate enter key 25. Next, cause "2-wood (Brassie)" to be displayed and, in cases where the player does not have one, operate scroll down key 26 to display "3-wood (Spoon)". Then, in the same manner as above, input the shot distance of the player himself if he has a corresponding club or cause the next club to be displayed by operating scroll down key 26 if he does not have it and repeat this procedure through "4-wood (Baffy)", "3-iron", and so forth to "9-iron", "Pitching wedge", "Approach wedge" and "Sand wedge". In cases where he has other clubs than those on display or a plurality of the same type of clubs on display, letters as well as respective shot distances are input by code input or any other appropriate means. In cases where the number of clubs whose shot distances have been input exceed 14, warning to notify that it is violation of rules is displayed on liquid crystal display 22. Further, putters are not subject to shot distance input. Standard shot distances for respective clubs to be yielded by average players may be input beforehand.

When starting a game, choose "5. Start" and then, when the image on liquid crystal display 22 has been changed to "(1) OUT; (2) IN . . . " and so forth, choose a specific starting course. Thereafter, with the image "(1) Bent Green; (2) Korean Green" and so on being displayed, choose the type of green to be used.

Setting any one or more categories from "1. Competition Setting" to "5. Start" may be conducted partly or entirely by golf course management device 1 through on-line communication or radio waves.

Figure 13:
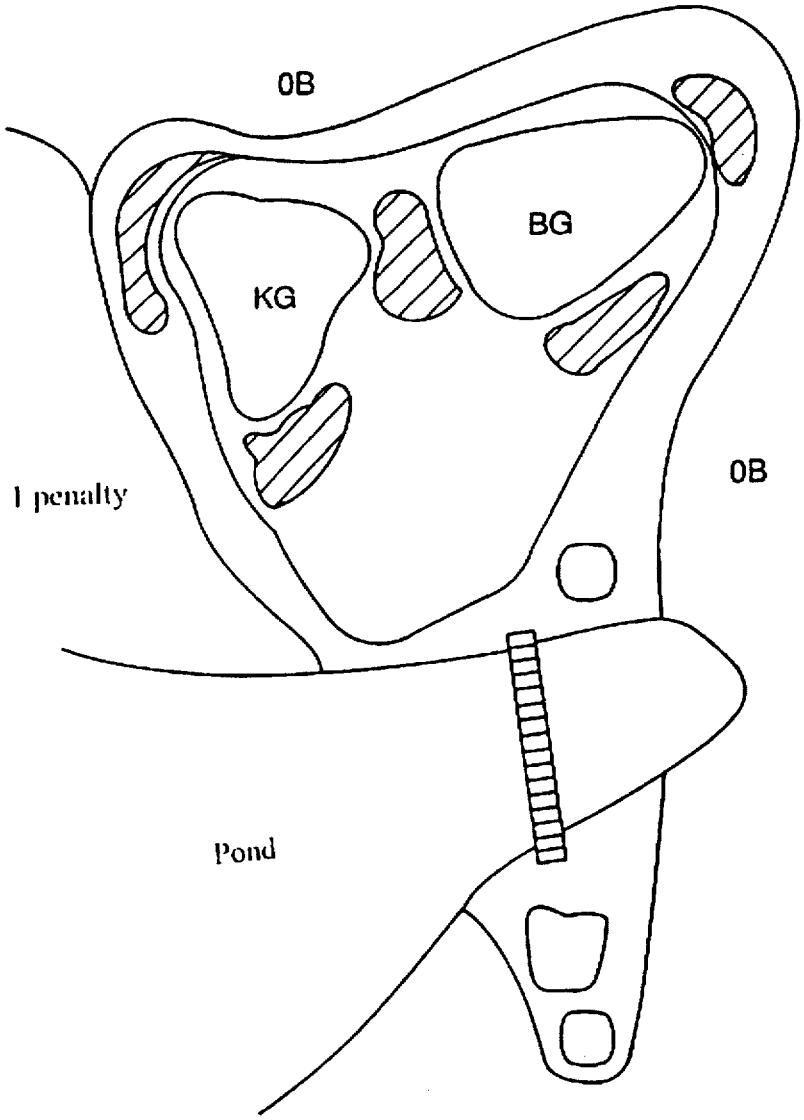
FIG. 13 is an explanatory drawing showing an image which displays the plan view of a hole stored in a golf course guidance device of same.
Figure 14:
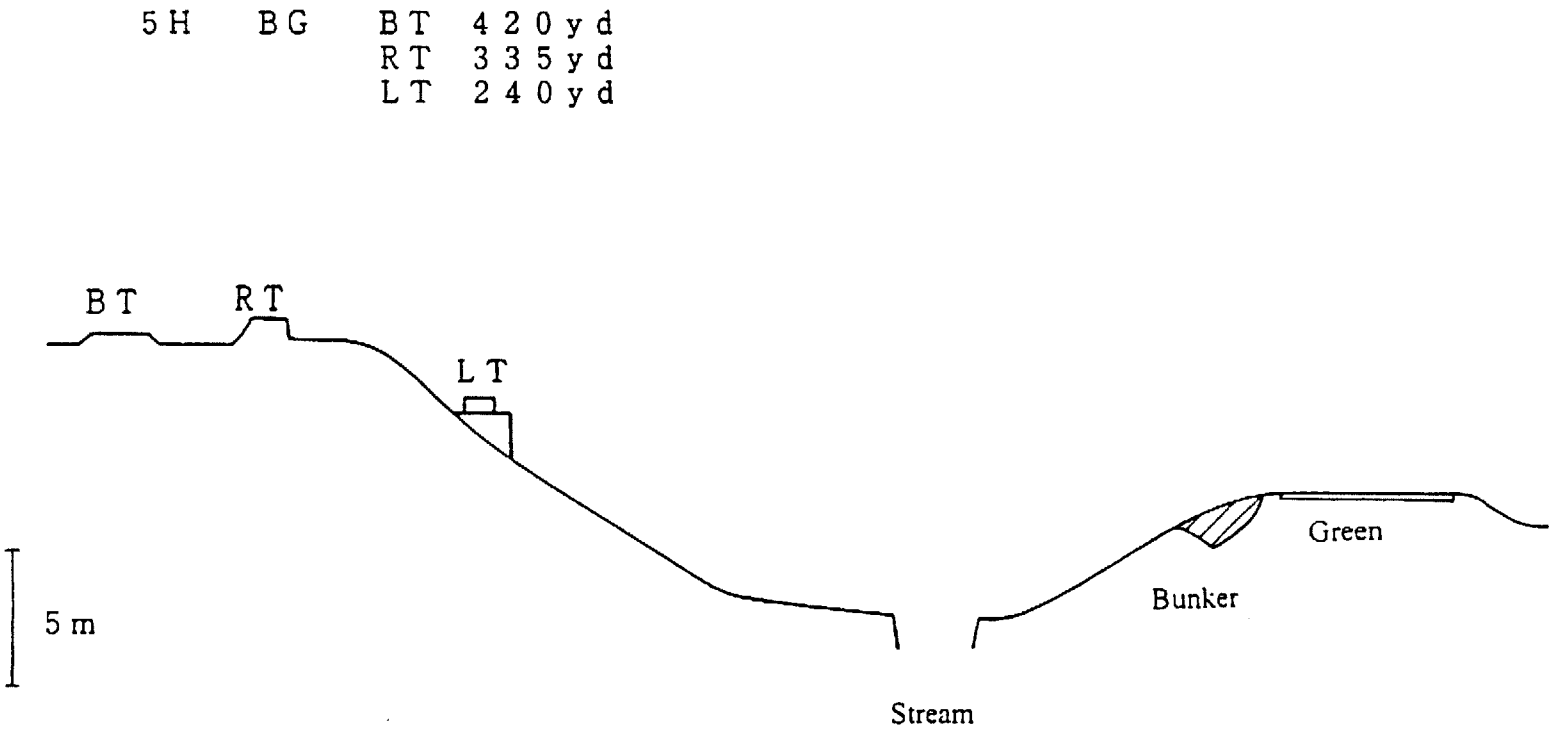
FIG. 14 is an explanatory drawing showing an image which displays difference in elevation of a hole stored in a golf course guidance device of same.

When the category of "6. Hole Terrain" is chosen for each hole, the plan view of a desired hole is displayed on liquid crystal display 22 by plan view storage means 55 of hole terrain data storage means 52 as shown in FIG. 13. Then, operate scroll down key 26 to cause elevation difference storage means 54 of hole terrain data storage means 52 to display a sectional view, i.e. an image illustrating elevation difference, of the specified green of the desired hole on liquid crystal display 22 as shown in FIG. 14. Data for each hole may be stored in hole terrain data storage means 52 beforehand so that various advice as to where to aim, such as "Aim at the eucalyptus tree deep inside on the right if want to play safe", "If confident in your shot distance, aim for a shortcut across the ravine", "If you drop the ball in the ravine on the left, hitting up will be difficult" and so forth, are displayed. When switching an image on liquid crystal display 22 from an elevation difference back to a plan view, operate scroll up key 26.

Then, when the category "7. Measure Distance" is chosen after the ball shot at the tee ground falls to the ground, such an image as shown in FIG. 7 is displayed on liquid crystal display 22. The cell where the ball has rested is displayed. To be more specific, if the ball is in cell #320, for example, such information as "Distance: 260 yds to the center of the green", "Elevation Difference: 15 yd rise" and "Center of Green: in the direction of the steel tower" are selected from the hole cell data table (shown in FIG. 8) of hole cell data storage means 56 and displayed on liquid crystal display 22.

Figure 15:
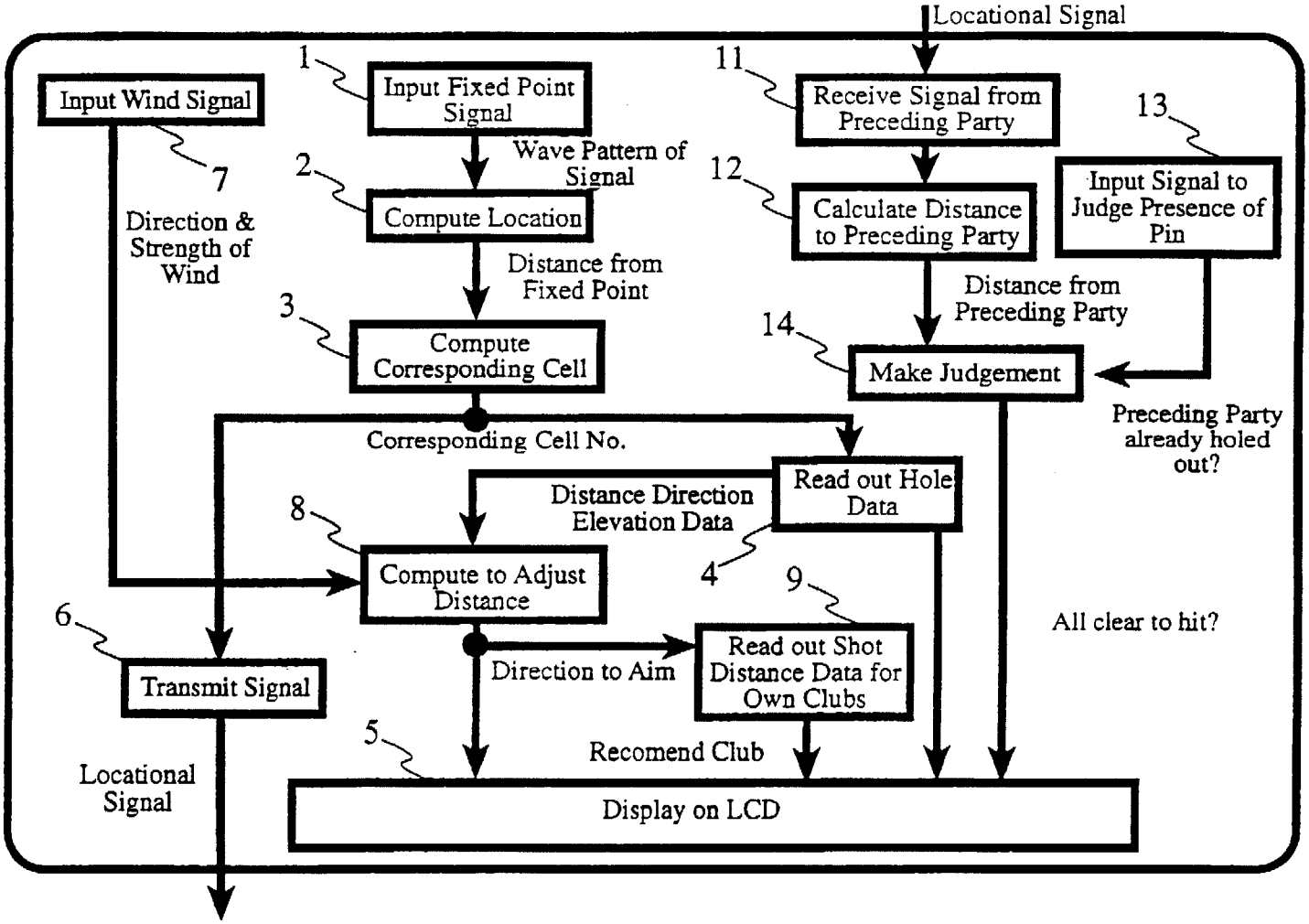
FIG. 15 is a flow chart explaining a function of the device, such as measuring a distance.

To summarize, as shown in FIG. 15, sub unit processing device 20 of a golf course guidance device 3 inputs fixed-location signals from a plurality of transmitters which are disposed, for example, in respective holes (Step 1); computes the location of the guidance device itself based on a wave pattern of the signals input as above and by means of sub unit location detection means 62 (Step 2); finds the cell corresponding to its location by arithmetic computation (Step 3); read data out of plan view storage means 55 and elevation difference storage means 54 of hole terrain data storage means 52 (Step 4); and displays the data on liquid crystal display 22 (Step 5). Golf course guidance device 3 also sends out the computed cell number through sub unit communication means 21 together with its own number, i.e. the ID number of the golf course guidance device itself (Step 6). The data thus sent out is received by main unit communication means 5 so that locations of all the golf course guidance devices 3 and their respective ID numbers are displayed on CRT display 11.

Signals indicating the direction and speed of wind which have been detected by wind detection means 49 of a pin 41 and transmitted from pin unit transmitting means 48 are received by sub unit transmitting means 21 and input into wind detection means 32, thereby permitting wind detection means 32 to detect the direction and speed of wind (Step 7). Based on the direction and speed of wind detected by wind detection means 32, the actual distance and the direction are adjusted by distance/direction adjusting means 74 (Step 8), and the actual direction and distance required of a shot are displayed on liquid crystal display 22 together with the wind speed, which is displayed as "Wind Speed: XX m/s", as well as the direction of wind, which is represented by an arrow on the corresponding green. Further, the actual distance and the elevation difference which have to be covered are compared with data for shot distances for respective clubs stored in club shot distance storage means 73, and a recommendable club is selected (Step 9), the club chosen to be recommended being displayed in such a manner as shown in FIG. 13.

The step of calculating a desired path of a ball is as follows. In cases where the distance to the green is too long to reach with a single shot, or it is not desirable to directly aim at the green due to a pond, a stream or the like or on other similar occasions, touch the cell which corresponds to the place where the shot is to be aimed on liquid crystal display 22 with light pen 27.

For example, in such a case as shown in FIG. 7, where the ball is at a location in the area corresponding to cell #320 and it is not desirable to directly aim at the green by way of a shortcut, touch a desired cell, for example cell #140, with light pen 27 so that data for the area corresponding to cell #140 is read out of hole cell data storage means 56 and that the data about the area from cell #140 to the center of the green is displayed. Then, if it is judged that aiming at the green is easy from cell #140, operate enter key 25.

When enter key 25 has been operated, data for the areas respectively corresponding to cells #320 and #140 is read out of hole cell data storage means 56, and the distance between both locations is computed based on information regarding the respective locations of the cells.

As the cells are set in a matrix, it is possible to find a cell having sides which are respectively orthogonal to the extension of a side of each one of the two cells and compute respective distances from this cell to the two cells, in other words in cases where this third cell is, for example, cell #340, the distance between cells #340 and #140 and the distance between cells #340 and #320, based on a number of cells between the two cells. Therefore, the distance between the cell where the ball is located and the target cell can be easily calculated by using the above two distances and finding the length of the oblique side defined thereby by the Pythagorean theorem. In cases where the cells are numbered according to their respective positions in the matrix, it is easy to find where two given cells intersect by comparing the cell numbers with respect to the radix.

In order to find difference in elevation, it is sufficient to simply calculate elevation difference between the two cells.

Figure 4:
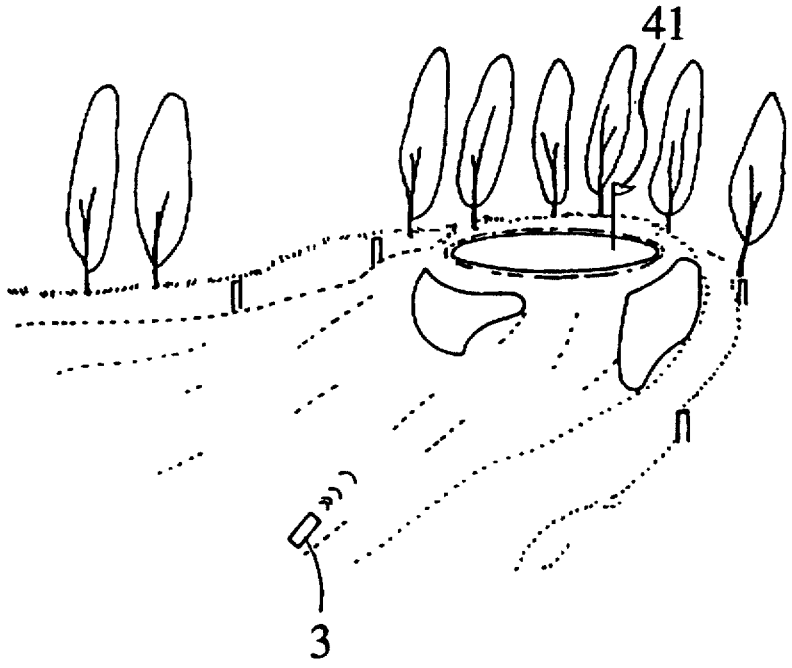
FIG. 4 is an oblique view showing how the golf course guidance device is used.

In cases where cells are not used or when a more precise distance has to be computed, orient golf course guidance device 3 towards pin 41 as shown in FIG. 4 and actuate distance measuring means 31, thereby sending out signals through sub unit communication means 21. Upon detecting the direction and speed of wind by means of wind detection means 49 and receiving the signals through pin unit receiving means 47, pin 41 sends signals which include information of the direction and speed of wind back to sub unit communication means 21 of golf course guidance device 3 through pin unit transmitting means 48. At this time, the length of time from when sub unit communication means 21 sends out radio waves until it receives incoming radio waves is measured by sub unit central processing device 20, thereby permitting distance measuring means 31 to measure the distance from the location where golf course guidance device 3 sent out the signals to pin 41, while wind detection means 32 detects the direction and speed of wind. Then, instead of the distance from the tee ground to pin 41 shown in FIG. 9, a message such as "Remaining Distance:xx yd" is displayed together with such a message as "Wind Speed:xx m/s" and an arrow which is displayed on an image of the corresponding green to indicate the direction of the wind.

Further, in cases where duration of the sending and returning of radio waves cannot be measured for some reason, such as when a preceding party is using the green so that pin 41 is not in cup 43, or in case of a blind hole or play is unable to proceed, "Please wait", "Measurement not possible" or any other similar message is displayed on liquid crystal display 22. At the same time, distance measuring means 31 of golf course guidance device 3 detects its own location by receiving signals from a satellite or transmitters already set in the golf course, and sub unit communication means 21 send out signals including data indicating its own location. Through communication between main unit communication means 5 of golf course management system 1 and sub unit communication means 21, golf course management system 1 detects the location of golf course guidance device 3 with its main unit location detection means 6, computes the distance from the location of golf course guidance device 3 to the green or pin 41 by means of main unit central processing device 4 and transmits signals including data indicating the computed distance through main unit communication means 5, thereby permitting the signals to be received by sub unit communication means 21 and distance measuring means 31 to display the remaining distance on liquid crystal display 22.

As measurement of wind above the green is not possible in this case, the direction of wind higher above ground is displayed between the tee ground and the green instead of on the green as shown in FIG. 13.

Of the methods of measuring distance which respectively use cells and radio waves, both or either one may be applied.

At the same time of distance measurement, upon receiving locational signals from golf course guidance device 3 of a preceding party (Step 11), a distance to the preceding party is calculated (Step 12), while the presence of signals from pin 41 is examined (Step 13) because transmittance of signals from pin 41 is terminated by signal stopping means 50 when pin 41 is removed from cup 43, and judgement is made as to whether the two parties are at a safe distance from each other (Step 14). For example, when the preceding party is on the green while the following party is within a 250 yd range therefrom, or, when a distance between the two parties is less than 300 yd, warning means 69 gives an alarm with "Too close to the preceding party: be careful" or a similar message being displayed on liquid crystal display 22 to warn the party.

Figure 17:
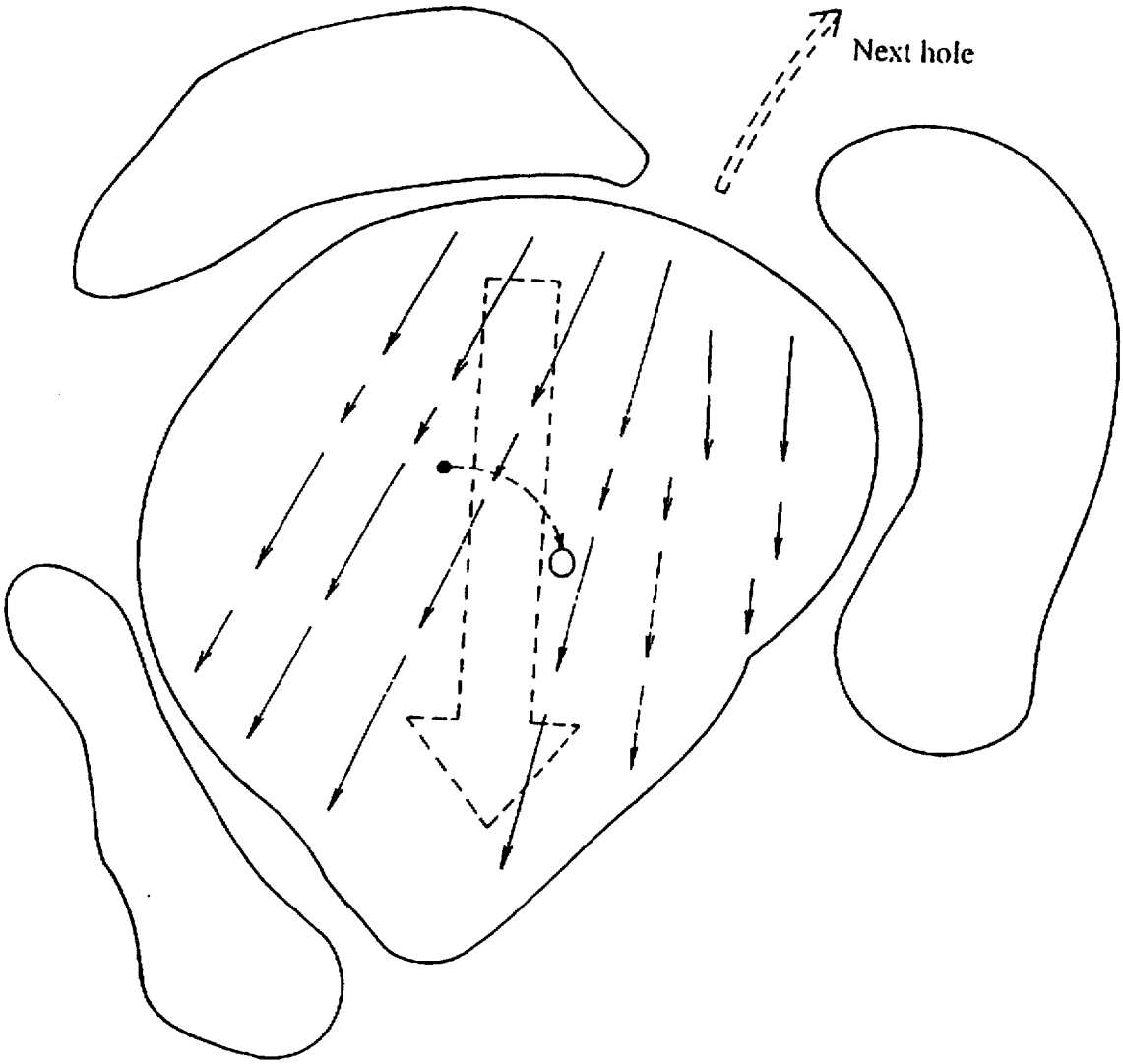
FIG. 17 is an explanatory drawing showing an image which displays the condition of a green stored in a golf course guidance device of same.

When the player's ball has reached the green, choose "8. Terrain of Green" so that grain and slope of the green are displayed by means of grain data storage means 57 and slope data storage means 58 of green data storage means 53, the grain of the grass being indicated in broken lines and the slopes being represented with respect to their degrees, for example, in the manner as shown in FIG. 17 wherein a 10 cm fall is represented by an arrow whose length represents the degree of slope. In other words, a longer arrow represents a relatively gentle slope while a shorter arrow represents a steeper slope. Slopes may be illustrated in the form of contour lines or three-dimensionally in lieu of or together with arrows.

Figure 18:
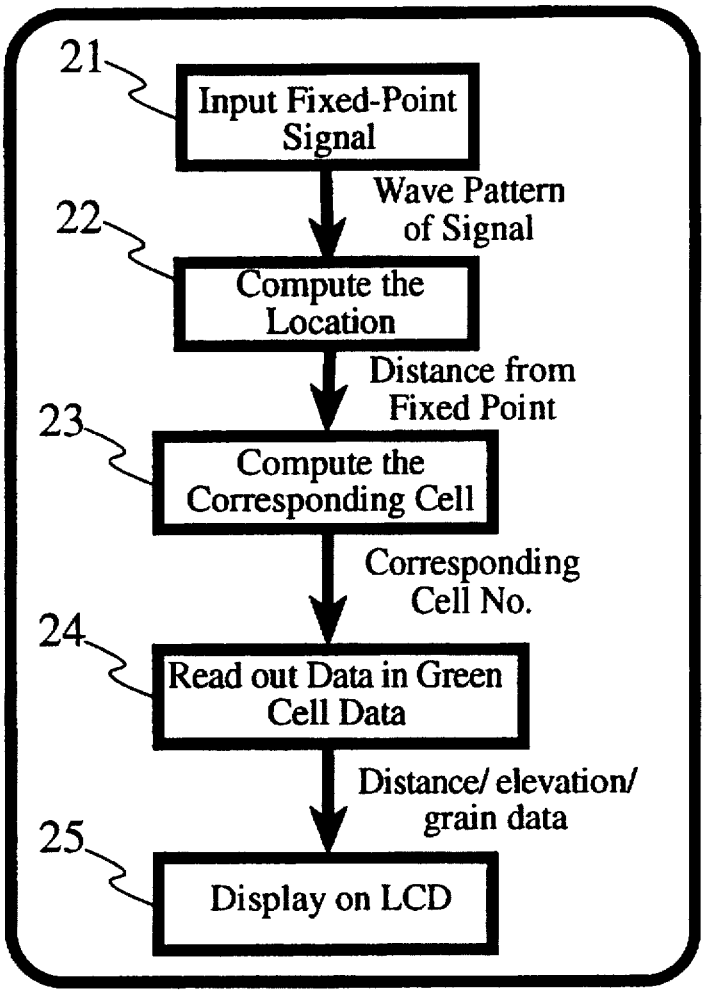
FIG. 18 is a flow chart to read out data for said green.

In this state, as shown in FIG. 18, sub unit central processing device 20 of golf course guidance device 3 inputs fixed-point signals from a plurality of transmitters which are disposed, for example, on each green (Step 21), computes its own location based on a wave form of the input signals by means of sub unit location detection means 62 (Step 22), finds the corresponding cell by arithmetic computation (Step 23), reads out data in green cell data storage means 59 shown in FIG. 10 (Step 24), and displays the data on liquid crystal display 22 (Step 25). In this case, as data for the cell where pin 41 is located is stored beforehand, the above steps simply calls for reading out data for the cell where pin 41 is located from the cell where the ball is currently located as endpoints. The cell where pin 41 is located may be input beforehand or on the spot so that data to indicate a direction of pin 41 may be computed based on data for the terrain between both cells.

In cases where cells are not used or when a more precise distance has to be computed, measurement may be conducted by orienting golf course guidance device 3 towards pin 41, emitting infrared light from the infrared sensor of distance measuring means 31 to pin 41, receiving the light reflected by pin 41 on the PSD, determining the distance to pin 41 by using the principle of triangulation, and displaying the measured distance on liquid crystal display 22.

Then, using light pen 27, indicate the respective locations of pin 41 and the user's ball so that they are displayed on liquid crystal display 22 as shown in, for example, FIG. 17. Meanwhile, sub unit central processing device 20 may compute and display a recommendable line for the ball, which is represented by broken lines in the drawing, by using elevation storage means 54 and bird's-eye view storage means 55 and may also display such advice as "Hard", "Somewhat hard", "Normal strength", "Somewhat softly" or "Softly" on liquid crystal display 22.

When all players have holed out, choose "9. Score Input" and input the score and the number of putts of each player using ten-key pad 23 and scroll keys 26 as shown in FIG. 12. When the 9th hole has been completed, gross scores of the respective players are automatically computed.

Figure 19:
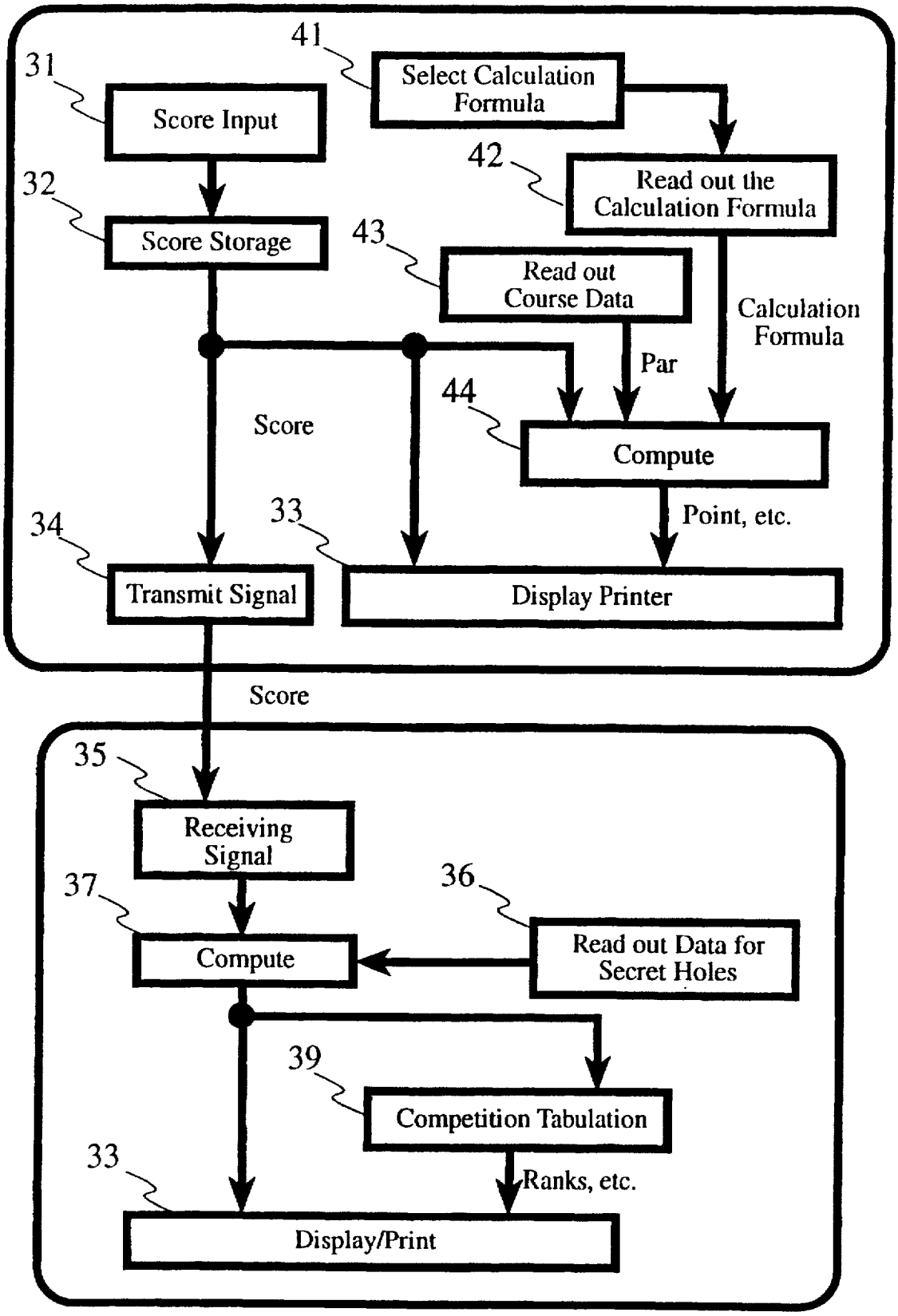
FIG. 19 is a flow chart illustrating processing of data, such as scores and so forth.

In other words, as shown in FIG. 19, when scores are input by using ten-key pad 23 or a similar means (Step 31), golf course guidance device 3 stores the scores in score storage means 30 (Step 32) and displays the scores on liquid crystal display 22 (Step 33). Meanwhile, after each score or scores of all players have been input, golf course guidance device 3 transmits the data to main unit communication means 5 (Step 34). If data is transmitted every time a score is input, it is possible to know the overall situation of the orders of players and so on in real time.

Then, the transmitted signals are received by main unit communication means 5 of golf course management device 1 (Step 35), data for secret holes set in memory 12 is read out in cases where the Peoria or the New Peoria system is used (Step 36), main unit processing device 4 performs computation based on the data thus read out or handicaps specified beforehand (Step 37), a result of computation is displayed on CRT display 11 and printed by means of printer 13 each time computation is completed or when all scores have been gathered and totaled (Step 38). A different procedure may be applied in a competition; for example, score tabulation may be conducted in real time specially for the competition (Step 39), upon which ranking of participants may be determined.

When making separate calculations in cases where, for example, separate special handicaps are set in a party, set handicaps with handicap setting means 65 and select a calculation formula (Step 41), read out the calculation formula (Step 42) as well as a par score for each hole stored in handicap setting means 65 (Step 43), compute points for score difference and so on by using sub unit central processing device 20 (Step 44), display a result of computation on liquid crystal display 22, and, if necessary, print it by means of printer 78. In this case, connect golf course guidance device 3 to an external printer (not shown) which serves as printer 78.

Figure 20:
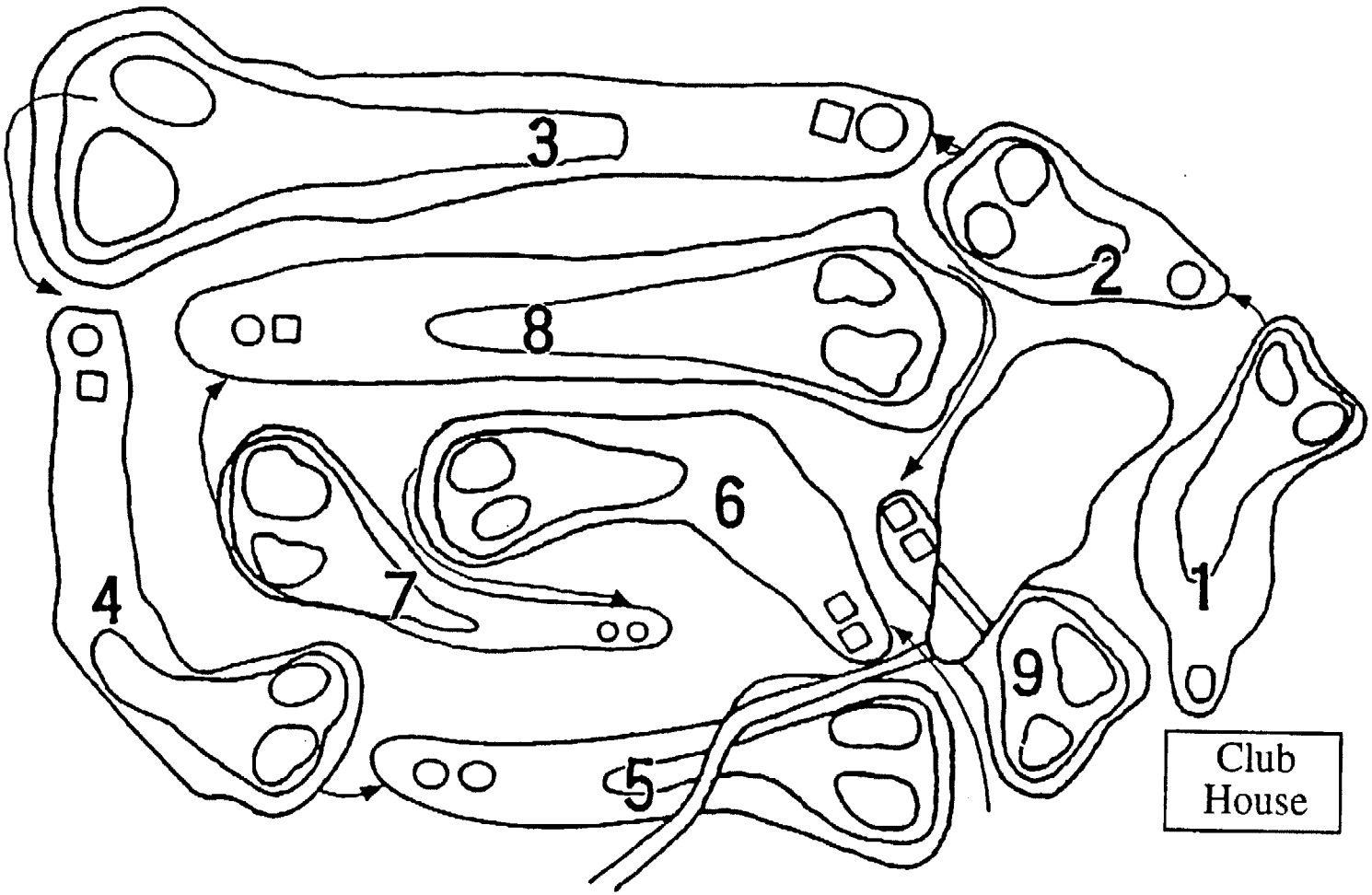
FIG. 20 is an explanatory drawing showing an image which displays the entire golf course.

When "10. Guidance for Next Hole" is chosen, such information as direction to access the next hole, location of a coffee house and so on are displayed on liquid crystal display 22 as shown in FIG. 17 or FIG. 20.

When holding a driving contest in a competition or a similar occasion, choose "11. Driving Contest Measurement" at a location where the ball comes to rest after the tee shot at a hole where the contest takes place, and measure the distance by orienting golf course guidance device 3 towards the tee ground in the same manner as the distance measurement described above. In this case, a signal receiving device and a transmitter are provided beforehand at appropriate locations, such as a tee mark on the tee ground in the same manner as pin 41.

Then, while displaying the measured distance as "Shot Distance:xx yd" or the like on liquid crystal display 22 of golf course guidance device 3, transmit signals including information of the player and his shot distance from sub unit communication means 21 to main unit communication means 5 of golf course management device 1 so that the name of the player and his shot distance are stored in memory 12. Data in memory 12 is updated only when a new distance is longer than the one already stored. In other words, memory 12 always saves data for the longest shot distance and deletes those of shorter distances.

In a similar manner as above, in case of a near-pin contest in a competition or a similar occasion, Choose "12. Near-pin Measurement" at a location where the ball comes to rest after have reached the green in one shot at a hole where the contest takes place, and measure the distance between golf course guidance device 3 and pin 41 according to the triangulation method by orienting the base length of golf course guidance device 3 towards pin 41 and emitting infrared light towards pin 41. As a distance to pin 41 is short and measured using infrared light according to the triangulation method, the distance to pin 41 is measured more accurately than when using radio waves.

Then, while displaying the measured distance as "xxx cm to the pin" on liquid crystal display 22 of golf course guidance device 3, signals are send out including information of the player and the distance of his ball to pin 41 from sub unit communication means 21 to main unit communication means of golf course management device 1 so that the name of the player and the distance to pin 41 are stored in memory 12. Data in memory 12 is updated only when a new distance is shorter than the one already stored. In other words, memory 12 always saves data for the shortest distance and deletes those of longer distances.

Then, when "13. Total" is chosen upon completion of all the holes, a gross score which is a total of scores of each player for the 18 holes, as well as his net score which is produced by the gross score minus his handicap, are calculated, stored in score storage means 30 and displayed on liquid crystal display 22. In case of the Peoria or the New Peoria system, handicap is calculated based on score for each hole. Then, connect golf course guidance device 3 of each person to printer 78, which may be disposed in front of the caddie master's office or at any other appropriate location beforehand, through on-line connection or off-line connection, and print out the data stored in score storage means 30 by means of this printer 78, thereby making a score card. Golf course guidance device 3 is made compact by providing a printer 78 separately.

For a competition, a score of each player is transmitted from each sub unit communication means 21 and received by main unit communication means 5 of golf course management device 1, and scores thus transmitted are totaled by main unit processing device 4 and stored in memory 12. When the Peoria or the New Peoria system is used, wherein handicaps are set based on calculated scores, data for scores alone may be transmitted, having golf course management device 1 calculate handicaps and so forth.

In case of a competition, competition scores are calculated only when all players participating in the competition have completed all the holes, and the order and specifically desired ranks are computed by golf course management device 1. The calculated ranking is printed out by printer 13, as well as such data stored in memory 12 as participants of a driving contest and a near-pin contest and their shot distances or distances to pin 41. In cases where a plurality of players have the same net score, which player should be ranked higher are determined based on other factors which are set beforehand, such as age difference, priority to a player with a lower handicap, priority to a player having a lower IN score (or OUT score) and so on.

Further, meals may be ordered during the course of a game in order to reduce the waiting time. In this case, choose "14. Meal Order".

Figure 21:
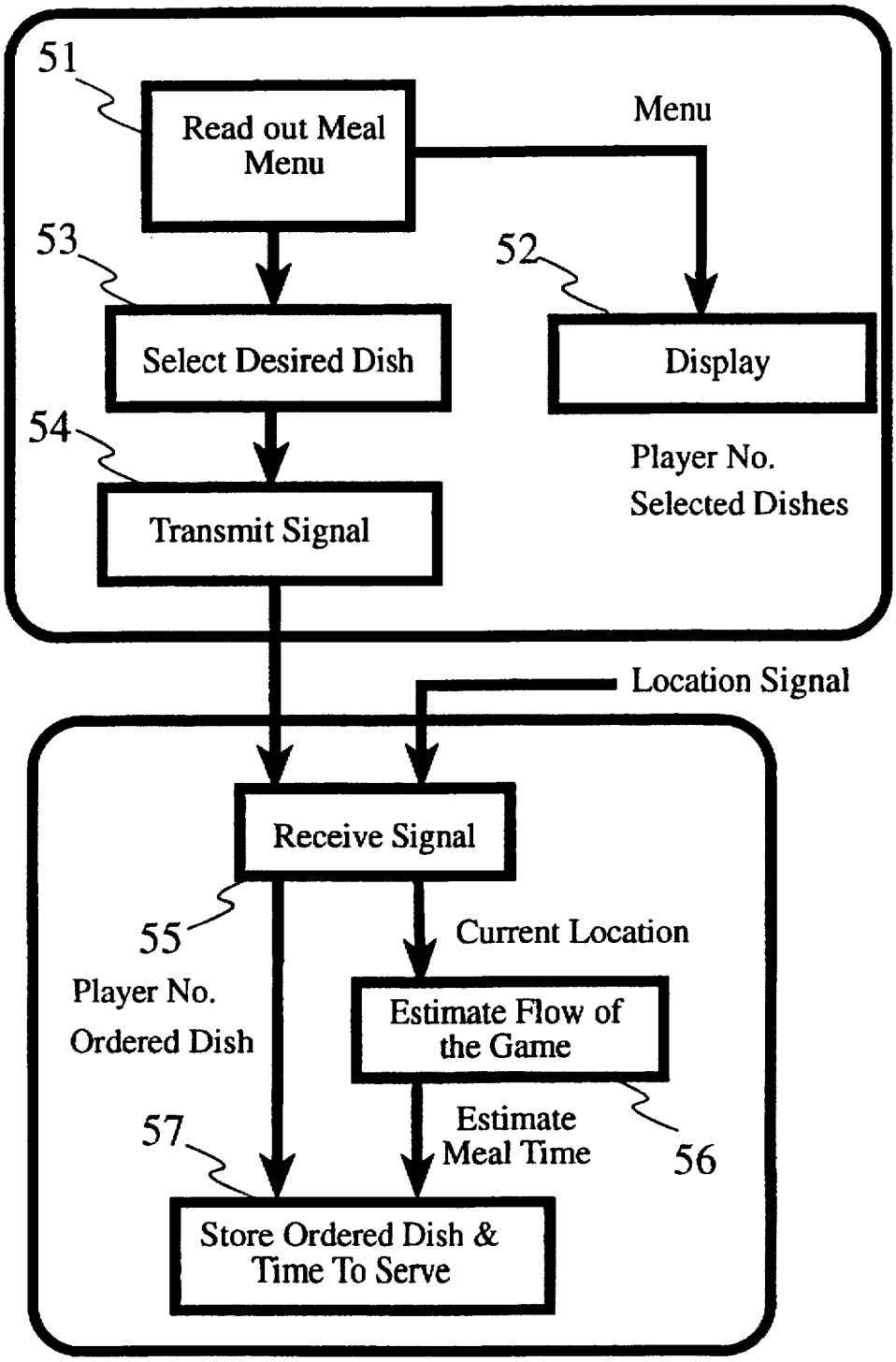
FIG. 21 is a flow chart of taking and processing orders for meals.

Then, as shown in FIG. 21, read out a meal menu (Step 51), display the menu on liquid crystal display 22 (Step 52), having indicated a desired dish on the menu by means of scroll keys 26, make the selection by means of enter key 25 (Step 53), and transmit the order by means of sub unit communication means 21 together with the identification number of player's golf course guidance device 3 and player's locational data (Step 54).

When main unit communication means 5 of golf course management device 1 receives the signals (Step 55), the time of the player's arrival at the restaurant is estimated based on his location detected by main unit central processing device 4 (Step 56) and the ID number of golf course guidance device 3, its locational data and the ordered dish are stored in memory 12 (Step 57).

In cases where the steps described above are automatically operated, set categories such as competition setting, member setting, handicap setting and start command beforehand and choose "15. Automatic Operation".

The system may be so configured as to execute such tasks as the hole terrain, the distance measurement, the green terrain, the score input and the direction to the next hole are executed in a cyclic order when this "Automatic Operation" command is chosen. In addition to the above tasks, it may also take orders for a meal at a specified location or around a specified time.

Figure 22:
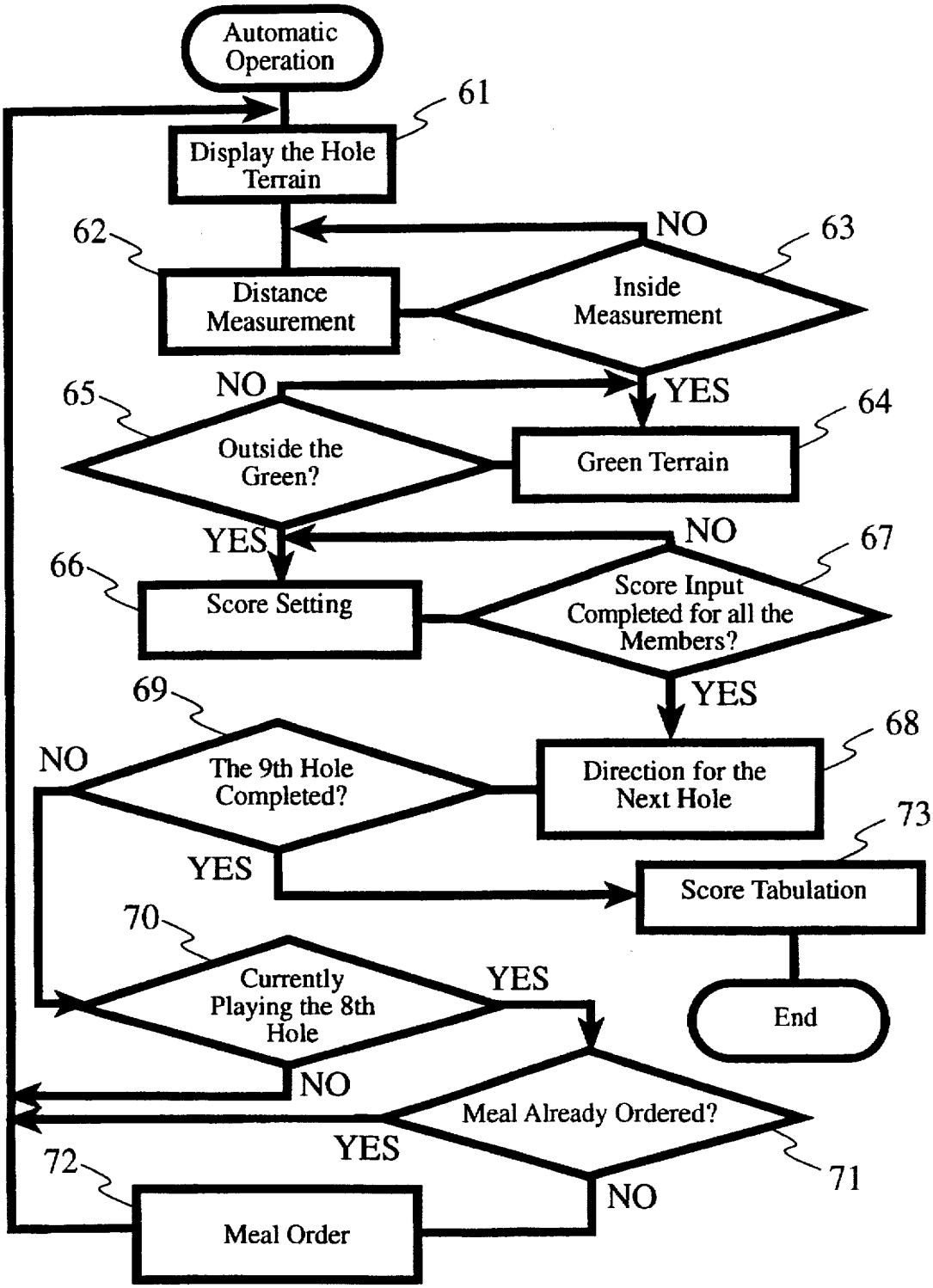
FIG. 22 is a flow chart showing a procedure of automatic processing.

More precisely, first of all, the terrain of the corresponding hole is displayed on liquid crystal display 22 (Step 22) as shown in FIG. 22. Then, when the display of the hole terrain is terminated by means of, for example, operation of enter key 25, the distance measurement is performed based on data stored in hole terrain data storage means 52 (Step 62). At the time of this distance measurement, judgement is made as to whether golf course guidance device 3 is within the boundary of the green of the hole (Step 63), and in cases where the device has been judged to be outside the green in Step 63, a normal distance measurement is conducted in Step 62. In cases where the device has been judged to be inside the green in Step 63, however, the distance is measured based on data stored in green data storage means 53 (Step 64).

Then, judgement is made again as to whether golf course guidance device 3 is outside the green (Step 65), and in cases where it is judged not to be outside the green in Step 65, the system returns to Step 64 wherein the process of distance measurement on a green is conducted based on data stored in green data storage means 53. In cases where it is judged to be outside the green in Step 65, the system proceeds to the score setting (Step 66).

After a score of each player has been input by means of ten-key pad 23, judgement is made as to whether scores of all the members have been input (Step 67), and in cases where it is judged that scores of all the players have not been input yet in Step 67, the system returns to Step 66 wherein further scores are input. In cases where it is judged that scores of all the members have been input in Step 67, the system proceeds to give directions to a next hole (Step 68).

In this step, judgement is made as to whether the 9th hole has been completed (Step 69). In cases where the result of the judgement in step 69 is negative, judgement is made as to whether the current hole is the 8th hole (Step 70), and if the result of the judgement in step 70 is negative, the system returns to Step 61 to display the hole terrain. On the other hand, if the current hole is judged to be the 8th hole in step 70, judgement is made as to whether a meal order has been made (Step 71). In cases where a meal order is found to have already been made in Step 71, the system returns to Step 61 to display the hole terrain in the same manner as above. In cases where it is found in Step 71 that a meal has not been ordered yet, a meal order is processed (Step 72), and the system then returns to Step 61.

In cases where it is judged in Step 69 that the 9 holes have been completed, scores are gathered and calculated (Step 73). In cases where all the 18 holes have already been completed, all scores and handicaps are calculated (according to a competition calculation method in case of a competition), whereupon the operation is terminated.

Should any question involving rules arise, choose "16. Rule Book" so that rules are read out from rule storage means 70 and that "(1) Sequence of Rules, (2) Classification by Categories, (3) Local Rules" are displayed on liquid crystal display 22. If, for example, the item "Classification by Categories" has been chosen, an image indicating such items as "(i) Bunkers, (ii) Greens, (iii) Clubs, . . . " and so forth is displayed. In cases where the question regarding the rules has arisen on a bunker for example, the item indicating "Bunkers" is selected.

When desiring a measurement system other than the one included in information on the display, i.e. the metric system when information on the display uses the yard system or vice versa, choose "17. Meter/Yard Conversion" so that figures on the display are converted into the other system by meter/yard display switching means 71.

Furthermore, in case of an accident or other emergency during a game, by choosing "20. Emergency" and transmitting signals from sub unit communication means 21 of golf course guidance device 3 to main unit communication means 5 of golf course management device 1, a message for informing of the occurrence of an accident and its location is displayed on CRT display 11. The system may be configured such that voice communication is provided between golf course guidance device 3 and golf course management device 1 in addition to the above.

Figure 23:
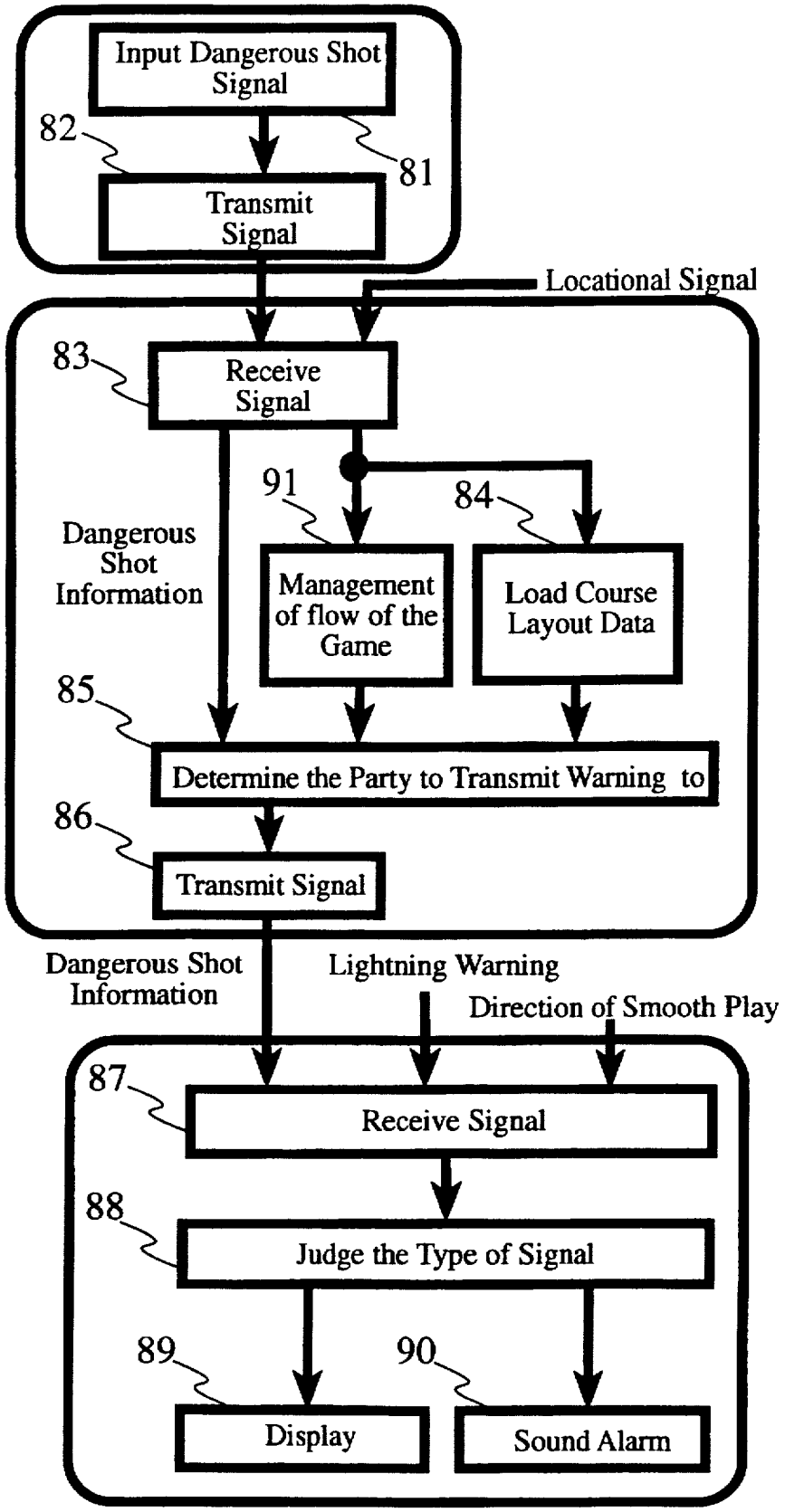
FIG. 23 is an explanatory drawing showing an image display of a golf course management device of same.

In cases where a ball is hit in a direction of another hole or where there are probably other people, operate emergency button 28 of golf course guidance device 3. When this emergency button 28 has been operated, a dangerous shot warning signal is input as shown in FIG. 23 (Step 81), the dangerous shot warning signal is sent out from sub unit communication means 21 together with a locational signal (Step 82), the transmitted signals are received by main unit communication means 5 of golf course management device 1 (Step 83), the course layout is read out from memory 12 (Step 84), golf course guidance device 3 of the player towards whom the dangerous shot is likely to approach is determined based on the course layout and the location of golf course guidance device 3 of the player who has sent the signals (Step 85), and a signal for giving a warning of the incoming dangerous shot is transmitted from main unit communication means 5 (Step 86).

The signal is received by sub unit communication means of golf course guidance device 3 which has been determined in the manner as above (Step 87), and the type of signal is judged by sub unit central processing device 20 (Step 88) and displayed on liquid crystal display 22 (Step 89), while warning is given by an alarm which is not shown in the drawings (Step 90).

Further, a lightning warning and the like are given to every golf course guidance device 3 in the same manner as above.

Figure 16:
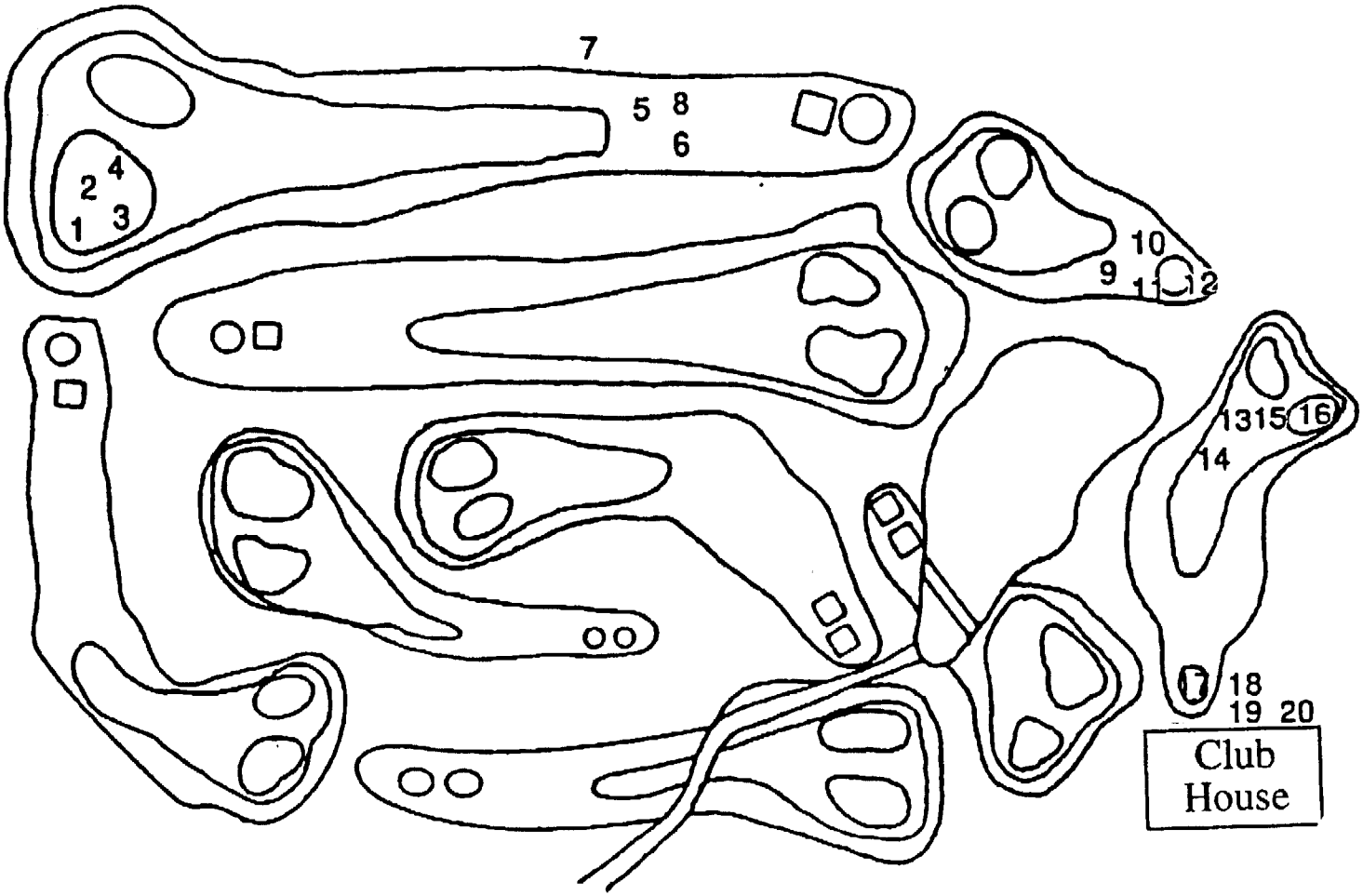
FIG. 16 is an explanatory drawing showing whereabouts of players throughout the course.

As shown in FIG. 16, golf course management device 1 has a plan view of 9 holes at a time or all the holes of the course continually displayed on CRT display 11, and surveys distribution of all golf course guidance devices 3 at specified time intervals by having sub unit communication means 21 of every golf course guidance device 3 transmit signals (Step 91). Locations of respective golf course guidance devices 3 may also be determined by means of having sub unit communication means 21 of each golf course guidance device 3 transmit signals to indicate its own location and displaying the locations of golf course guidance devices 3 on CRT display 11. Another way to determine whereabouts of golf course guidance devices 3 is to connect a radar or a similar device to golf course management device 1, detect the location of each golf course guidance device 3 by means of main unit location detection means 6 of golf course management device 1 and display the detected locations on CRT 11. Each of these methods may be applied alone or in combination with the other.

In cases where a party is within 250 yds of a green while the preceding party is on the green or where the distance to the preceding party does not exceed 300 yds, a signal may be transmitted from main unit communication means 5 to give warning by sounding warning means 69 and displaying a message such as "Too close to the preceding party: Exercise Care" or the like on liquid crystal display 22.

On the other hand, in cases where a party is behind the preceding party by one full hole or more, a signal is transmitted from main unit communication means 5 to alert the party by sounding warning means 69 and displaying a message such as "Please cooperate to ensure smooth flow of the game" or the like on liquid crystal display 22.

When using a coffee house or a restaurant for eating and drinking and/or shopping, it is possible to have an employee or staff member of the facility choose "19. Settling Account" and transmit data for consumed food or beverage and/or shopping from golf course guidance device 3 to main unit communication means 5 of golf course management device 1, wherein the transmitted data is stored in memory 12, so that all the items accountable to the corresponding player can be processed at one time at the time of final settlement.

Furthermore, if a map or a similar data is stored, the category "18. Golf Course Guide" may also be used as a direction to the golf course itself by using a GPS. Golf course guidance device 3 may have such a structure as to permit an IC card or a CD-ROM to be connected in order to store a map therein.

As data for holes, greens and so on varies depending on a golf course, this kind of data may be reloadably input and stored by using a CD-ROM, an IC card or a public communication line.

According to the configuration of the present embodiment, a pin unit receiving means 47, a pin unit transmitting means 48 and the like are provided inside a pin 41 in order to determine the location of a green. These parts, however, may be disposed around a green, being embedded in the ground.

Some of the functions, such as distance measurement, may be provided with a lock so that a device can be used in a club championship or other competitions.

Furthermore, human-detection sensors or the like may be provided around each green for the purpose of security check for night time and other hours when players are not in the course. In this case, should anything be detected by a human-detection sensor, a signal is transmitted to main unit communication means 5 so that the location of the abnormality is displayed on CRT display 11 when golf course management device 1 is turned on the following morning. In addition, the system may be configured such that warning is sent to a specified telephone or the like through a public communication line in cases where any abnormality is detected.

A level gauge or a similar device to measure a slope may be incorporated in golf course guidance device 3 so that by placing golf course guidance device 3 on the ground with its front side being oriented in the direction in which a shot is going to be aimed, inclinations of all the four direction from golf course guidance device 3 are detected. In cases where its front end or the right side is inclined downward, in other words in cases where the left foot or the toes are lower, liquid crystal display 22 displays "Be careful of slice". On the other hand, in cases where its front end or the right side is inclined upward, in other words in cases where the left foot or the toes are higher, liquid crystal display 22 displays "Be careful of hook". Further, in cases where the user is left-handed, "right" and "left" are treated the other way around.

As described above, a golf course guidance method, a device for same and a system to manage a golf course according to the present invention is suitable to be used for giving guidance inside and outside a golf course as to each hole, a green and so on of said golf course as well as quick processing in a competition.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A guidance method for a golf course comprising the steps of:

providing a plan view of said golf course;

dividing said plan view into a plurality of cells, each having definable characteristics;

at least one of said plurality of cells including: a cup, a pin having a vertical axis, said cup having means for holding said pin whereby said pin is removable from said cup, and means, connected to said pin, for measuring weather and generating a weather data responsively thereto;

storing a data corresponding to said definable characteristics of each of said plurality of cells;

selecting at least two of said plurality of cells;

generating an advice from at least one of said data and said weather data corresponding to said at least two of said plurality of cells; and transmitting said advice to a user of said golf course.

2. A golf course aid method as defined in claim 1 wherein said step of selecting at least two includes:

detecting a location of said user;

selecting a location cell of said plurality of cells which corresponds to said location of said user; and said location cell being one of said at least two of said plurality of cells.

3. A golf course aid method as defined in claim 1 wherein said step of generating an advice further includes calculating a distance between said at least two of said plurality of cells.

4. A golf course aid system, comprising:

computing means having means for storing permanent data, each datum representing a feature of a discrete cell portion of a geographic area of said golf course;

at least one said discrete cell portion having a means for generating a weather data, said means for generating weather data including: a cup, a pin having a vertical axis, said cup having means for holding said pin whereby said pin is removable from said cup, and means, connected to said pin, for measuring weather and generating said weather data responsively thereto;

said computing means including means for generating first transient data responsively to at least one of said weather data and said permanent data;

a first guidance device, carried by a first user, for outputting a first signal, perceptible to said first user, responsively to at least one of said first transient data and said permanent data;

said first guidance device including means for indicating a position of said first player; and a second guidance device, carried by a second user, including means for generating a second signal, responsive to said position of said first player, and outputting said second signal.

5. A golf course aid system as in claim 4, wherein:

said guidance device includes means for transmitting second transient data entered by said user to said computing means; and said computing means includes means for generating third transient data responsively to at least one of said first transient data, said second transient data, and said permanent data;

said guidance device including means for outputting a further signal responsively to said second transient data.

6. A golf course aid system as in claim 5, further comprising means for detecting a location of said guidance device on said golf course.

7. A golf course aid system as in claim 6, wherein said means for detecting includes means for indicating a one of said cell portions in which said guidance device is located.

8. A golf course aid system as in claim 4, further comprising:

means for detecting a location of said guidance device on said golf course;

said means for detecting including means for indicating a one of said cell portions in which said guidance device is located; and said guidance device including means for outputting a signal, perceptible to said user, responsively to said means for indicating.

9. A golf course aid system as in claim 4, further comprising:

means for measuring a property of said cell portion and transmitting data relating to said property to said computing means;

means for calculating second transient data responsively to said data relating to said property; and said guidance device including means for outputting a further signal responsively to said second transient data.

10. A golf course aid system as in claim 9, further comprising means for detecting a location of said guidance device on said golf course.

11. A golf course aid system as in claim 10, wherein said means for detecting includes means for indicating a one of said cell portions in which said guidance device is located.

12. A golf course aid system as in claim 11, further comprising:

means for calculating third transient data responsively to said means for indicating; and said guidance device including means for outputting a further signal responsively to said third signal.

13. A golf course aid system, comprising:

first and second guidance devices carried by first and second users of said golf course, respectively;

said first guidance device having means for indicating a position on said golf course of said first user and transmitting a position indication responsive to said position on said golf course of said first user;

a base computer having means for receiving said position indication;

said base computer having means for generating secondary data responsively to said position indication and transmitting said secondary data;

said second guidance device having means for receiving said secondary data and outputting a signal perceptible to said second user;

said base computer including means for storing permanent data, each datum representing a feature of a discrete cell portion of a geographic area of said golf course;

at least one said discrete cell portion having a means for generating a weather data and transmitting said weather data to said base computer, said means for generating weather data including: a cup, a pin having a vertical axis, said cup having means for holding said pin whereby said pin is removable from said cup, and means, connected to said pin, for measuring weather and generating said weather data responsively thereto; and said base computer including means for generating first transient data responsively to at least one of said permanent data and said weather data.

14. A golf course aid system as in claim 13, wherein:

said first and second guidance device include means for transmitting second transient data entered by said first and second users, respectively to said base computer;

said base computer includes means for generating third transient data responsively to at least one of said first transient data, said second transient data, and said permanent data; and said first and second guidance device further including means for outputting a further signal responsively to said third transient data.

15. A golf course aid system as in claim 14, wherein said means for means receiving includes locator means for detecting a location of said first guidance device.

16. A golf course aid system as in claim 15, wherein said locator means for includes means for detecting a one of said cell portions in which said first guidance device is located.

17. A golf course aid system, comprising:

base computer having means for storing permanent cell data concerning cells;

each cell representing a discrete portion of a geographic plan of said golf course;

each permanent cell datum representing a piece of descriptive information concerning a corresponding one of said cells;

means for generating other data, said means for storing including means for storing said other data;

said means for generating other data including: a cup, a pin having a vertical axis, said cup having means for holding said pin whereby said pin is removable from said cup, means, connected to said pin, for measuring weather and generating weather data responsively thereto, and said base computer means having means for receiving said weather data;

means for generating transient cell data from at least one of said cell data and said other data; and a guidance device, carried by said user, for displaying said permanent cell data and said transient cell data.

18. A golf course guidance device as described in claim 17 further comprising:

means for detecting a first location on said golf course; and said means for displaying including means for displaying said first location.

19. A golf course guidance device as described in claim 18 further comprising:

means for determining a second location;

means for calculating a desired path of a ball between said first and second locations;

means for determining at least one property of said path; and said means for displaying including means for displaying said property.

20. A golf course guidance device as described in claim 19 wherein said permanent data includes at least one of:

a size of said cell;

an elevation of said cell;

a slope of a ground of said cell;

a location of at least one of a tee, a green, a pin, and a hazard;

a position of another of said cells;

a condition of soil in said cell;

a type of vegetation in said cell;

a condition of said vegetation.

21. The system of claim 17 wherein:

said means for measuring weather includes at least one of means for measuring wind direction, means for measuring wind velocity, means for measuring temperature, means for measuring barometric pressure, and means for measuring precipitation.

22. The system of claim 21, wherein:

said means for measuring weather includes said means for measuring wind velocity;

said means for measuring wind velocity including:

a flag attached to said pin;

said flag oscillating at a flutter frequency responsively to said wind velocity; and means for measuring said flutter frequency.

23. The system of claim 21, wherein:

said cup includes registration means for fixing an angular position of said pin about said vertical axis;

said means for measuring weather includes said means for measuring wind direction; and said means for measuring wind direction includes means for detecting an angular position of said flag relative to said registration means.

* * * * *